US010617231B2

(12) United States Patent
Gonzalez et al.

(10) Patent No.: US 10,617,231 B2
(45) **Date of Patent: *Apr. 14, 2020**

(54) SHELVING SYSTEM

(71) Applicant: SPG INTERNATIONAL LLC, Covington, GA (US)

(72) Inventors: Arturo Gonzalez, Lilburn, GA (US); Steven M. Kessell, Loganville, GA (US); Michael D. Potter, Marydel, DE (US); Jerry Vance Foster, III, Lawrenceville, GA (US)

(73) Assignee: SPG INTERNATIONAL LLC, Covington, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/165,345

(22) Filed: Oct. 19, 2018

(65) Prior Publication Data

US 2019/0053642 A1 Feb. 21, 2019

Related U.S. Application Data

(63) Continuation of application No. 15/886,636, filed on Feb. 1, 2018, now Pat. No. 10,104,987, which is a (Continued)

(51) Int. Cl.
*A47F 5/08* (2006.01)
*A47B 95/00* (2006.01)
(Continued)

(52) U.S. Cl.
CPC ..... *A47F 5/08* (2013.01); *A47B 47/00* (2013.01); *A47B 47/022* (2013.01);
(Continued)

(58) Field of Classification Search
CPC ... A47B 57/485; A47B 57/565; A47B 96/027; A47B 96/067; A47B 96/14; A47B 47/02;
(Continued)

(56) References Cited

U.S. PATENT DOCUMENTS 239,909 A 4/1881 Woodward
291,030 A 1/1884 Clapper
(Continued)

FOREIGN PATENT DOCUMENTS

CN 1132999 10/1995
CN 101868166 A 10/2010
(Continued)

OTHER PUBLICATIONS

Select components and views of a shelving system, Global Industrial (www.globalindustrial.com), produced by InterMetro Industries Corp in Case No. 13:18-cv-00116, *SPG International, LLC* v. *InterMetro Industries Corp* (19 pages).
(Continued)

*Primary Examiner* — Jennifer E. Novosad
(74) *Attorney, Agent, or Firm* — Elizabeth M. Campbell Tressler

(57) ABSTRACT

A shelving system includes a plurality of horizontal support members, each horizontal support member having a length; a plurality of wall supports, each wall support including a first surface on which at least a portion of a horizontal support member rests; a plurality of brackets, each bracket attachable to the horizontal support members at different positions along the length of the horizontal support member; a plurality of vertical support members, each vertical support member coupled to at least one bracket; and a shelf attached to at least two of the plurality of vertical support members.

30 Claims, 9 Drawing Sheets

Related U.S. Application Data continuation of application No. 15/675,368, filed on Aug. 11, 2017, now Pat. No. 9,883,755, which is a continuation of application No. 15/026,519, filed as application No. PCT/US2014/058308 on Sep. 30, 2014, now Pat. No. 9,770,122.

(60) Provisional application No. 61/885,969, filed on Oct. 2, 2013, provisional application No. 61/885,480, filed on Oct. 1, 2013.

(51) Int. Cl.

| | |
|---|---|
| ***A47B 57/04*** | (2006.01) |
| ***A47B 96/07*** | (2006.01) |
| ***A47B 96/06*** | (2006.01) |
| ***A47B 96/02*** | (2006.01) |
| ***A47B 47/02*** | (2006.01) |
| ***A47B 57/40*** | (2006.01) |
| ***A47B 57/30*** | (2006.01) |
| ***A47F 5/10*** | (2006.01) |
| ***A47B 57/56*** | (2006.01) |
| ***A47B 47/00*** | (2006.01) |
| ***A47B 57/48*** | (2006.01) |
| ***A47B 96/14*** | (2006.01) |

(52) U.S. Cl.

CPC ..... *A47B 57/045* (2013.01); *A47B 57/30* (2013.01); *A47B 57/402* (2013.01); *A47B 57/485* (2013.01); *A47B 57/565* (2013.01); *A47B 95/008* (2013.01); *A47B 96/027* (2013.01); *A47B 96/028* (2013.01); *A47B 96/06* (2013.01); *A47B 96/061* (2013.01); *A47B 96/067* (2013.01); *A47B 96/068* (2013.01); *A47B 96/07* (2013.01); *A47B 96/14* (2013.01); *A47B 96/1408* (2013.01); *A47F 5/0892* (2013.01); *A47F 5/103* (2013.01)

(58) Field of Classification Search

CPC ... A47B 47/021; A47B 47/022; A47B 57/045; A47B 57/04; A47B 57/06; A47B 57/30; A47B 57/402; A47B 57/42; A47B 57/54; A47B 57/545; A47B 57/56; A47B 95/008; A47B 96/07; A47B 2220/0041; A47B 2220/0036; A47B 96/061; A47B 96/1408; A47B 57/028; A47B 57/45; A47F 5/08; A47F 5/13; A47F 5/0838; A47F 5/0853; A47F 5/103; A47F 5/0892

USPC .... 211/87.01, 90.01, 90.02, 90.04, 193, 103, 211/94.01, 189, 117; 248/214, 226.11, 248/227.4, 228.1, 228.6, 245, 250, 316.1, 248/242, 241, 243, 235, 247, 248, 220.42, 248/220.43

See application file for complete search history.

(56) References Cited

U.S. PATENT DOCUMENTS

| | | | |
|---|---|---|---|
| 309,360 | A | 12/1884 | Roberts |
| 663,784 | A | 12/1900 | Porter |
| 870,439 | A | 11/1907 | Kade |
| 1,424,284 | A | 8/1922 | Dyke |
| 1,560,122 | A | 11/1925 | Vance |
| 1,582,100 | A | 4/1926 | Troppman |
| 1,620,841 | A | 3/1927 | Vance |
| 1,698,974 | A | 1/1929 | Vance |
| 1,702,937 | A | 2/1929 | Friedemann |
| 1,983,858 | A | 12/1934 | Karnes |
| 2,008,180 | A | 7/1935 | Karnes |
| 2,246,090 | A | 6/1941 | Filer |
| 2,263,282 | A | 11/1941 | Welch et al. |
| 2,534,952 | A | 12/1950 | Corner |
| 2,693,884 | A | 11/1954 | Gurries |
| 2,772,846 | A | 12/1956 | Skar |
| 2,788,949 | A | 4/1957 | Gurries |
| 2,790,559 | A | 4/1957 | Stephenson et al. |
| 2,912,119 | A | 11/1959 | Robinson |
| 2,919,034 | A | 12/1959 | Levy |
| 2,933,196 | A | 4/1960 | Childs |
| 2,940,601 | A | 6/1960 | Smith |
| 2,940,603 | A | 6/1960 | Riedmaier et al. |
| 2,971,805 | A | 2/1961 | Weiss |
| 2,975,908 | A | 3/1961 | Huet |
| 2,983,389 | A | 5/1961 | Trautmann |
| 3,018,900 | A | 1/1962 | Huet |
| RE25,156 | E | 4/1962 | Gingher et al. |
| 3,040,905 | A | 6/1962 | Gingher et al. |
| 3,044,632 | A | 7/1962 | Schild |
| 3,044,634 | A | 7/1962 | Oztekin |
| 3,057,483 | A | 10/1962 | Derman |
| 3,097,822 | A | 7/1963 | Attwood |
| 3,100,572 | A | 8/1963 | Gingher et al. |
| 3,127,146 | A | 3/1964 | Fisher |
| 3,130,693 | A | 4/1964 | Shell |
| 3,184,068 | A | 5/1965 | Wende |
| 3,194,528 | A | 7/1965 | Chesley |
| 3,199,822 | A | 8/1965 | Ruhnke |
| 3,207,322 | A | 9/1965 | Pedersen |
| 3,212,648 | A | 10/1965 | Baker, Jr. et al. |
| 3,216,377 | A | 11/1965 | Gunn |
| 3,221,678 | A | 12/1965 | Doherty |
| 3,229,822 | A | 1/1966 | Janus |
| 3,229,823 | A | 1/1966 | Hummer |
| 3,250,584 | A | 5/1966 | Tassell |
| 3,273,847 | A | 9/1966 | Berman |
| 3,294,351 | A | 12/1966 | Rollins, Jr. |
| 3,316,863 | A | 5/1967 | Zock |
| 3,353,684 | A | 11/1967 | Chesley |
| 3,355,134 | A | 11/1967 | Chesley |
| 3,358,956 | A | 12/1967 | Thornton |
| 3,371,798 | A | 3/1968 | D'Altrui |
| 3,450,270 | A | 6/1969 | Brown |
| 3,471,112 | A | 10/1969 | MacDonald et al. |
| 3,479,975 | A | 11/1969 | Ferdinand et al. |
| 3,495,718 | A | 2/1970 | Romero |
| 3,512,654 | A | 5/1970 | Olsen et al. |
| 3,517,623 | A | 6/1970 | Goldstein et al. |
| 3,556,306 | A | 1/1971 | Shell |
| 3,561,608 | A | 2/1971 | Weider et al. |
| 3,565,020 | A | 2/1971 | Schier |
| 3,565,381 | A | 2/1971 | Oliver |
| 3,572,626 | A | 3/1971 | Bertschi |
| 3,587,867 | A | 6/1971 | Fenwick |
| 3,595,404 | A | 7/1971 | Goldstein |
| 3,602,159 | A | 8/1971 | Marschak |
| 3,602,374 | A | 8/1971 | Alabaster |
| 3,612,291 | A | 10/1971 | Skubic |
| 3,627,247 | A | 12/1971 | Krikorian |
| 3,631,821 | A | 1/1972 | Zachariou |
| 3,645,486 | A | 2/1972 | Ferdinand et al. |
| 3,695,569 | A | 10/1972 | Pullan |
| 3,701,325 | A | 10/1972 | Fenwick |
| 3,730,108 | A | 5/1973 | Stroh |
| 3,740,776 | A | 6/1973 | Lazarus |
| 3,759,191 | A | 9/1973 | Freeman |
| 3,765,344 | A | 10/1973 | Ferdinand et al. |
| 3,784,025 | A | 1/1974 | Dumit |
| 3,793,655 | A | 2/1974 | Harris et al. |
| 3,827,377 | A | 8/1974 | Aughtry, Jr. |
| 3,854,686 | A | 12/1974 | Konstant |
| 3,885,675 | A | 5/1975 | Hultenby et al. |
| 3,993,002 | A | 11/1976 | Stroh |
| 4,018,167 | A | 4/1977 | Spangler |
| 4,064,996 | A | 12/1977 | Shillum |
| 4,098,480 | A | 7/1978 | Neumann |
| 4,101,108 | A | 7/1978 | Klein |
| 4,109,797 | A | 8/1978 | Brunette |
| 4,116,509 | A | 9/1978 | Smith |
| 4,122,955 | A | 10/1978 | Celms |

(56) References Cited

U.S. PATENT DOCUMENTS 4,146,140 A 3/1979 Suter et al.
4,150,753 A 4/1979 Stahl et al.
4,174,086 A * 11/1979 Verberkmoes ..... A47B 5/04 248/242
4,189,123 A 2/1980 Johnson
4,190,002 A 2/1980 Redemann
4,197,950 A 4/1980 Ovitz, III
4,201,139 A 5/1980 Suttles
4,205,815 A 6/1980 Sauer et al.
4,230,052 A 10/1980 Champagne
4,285,436 A 8/1981 Konstant et al.
4,286,719 A 9/1981 Hall
4,312,086 A 1/1982 Bianco
4,332,204 A 6/1982 Hewell
4,360,181 A 11/1982 Burkholder
4,367,819 A 1/1983 Lewis
4,378,925 A 4/1983 Griffin
4,390,302 A 6/1983 Sanfeliu-Marimon
4,396,125 A 8/1983 Rowader
4,397,432 A 8/1983 Resetar
4,444,323 A 4/1984 Travis
4,455,007 A 6/1984 Varon et al.
4,534,529 A 8/1985 Dorner
4,589,349 A 5/1986 Gebhardt et al.
4,592,286 A 6/1986 Trubiano
4,615,503 A 10/1986 Garfinkle
4,623,065 A 11/1986 Cooper
4,624,376 A 11/1986 Bertram
4,627,543 A 12/1986 Nicely
4,684,094 A 8/1987 Everett
4,700,916 A 10/1987 Bastian et al.
4,938,442 A 7/1990 Mastrodicasa
4,951,908 A 8/1990 Kallio
4,960,210 A 10/1990 Spamer
D311,858 S 11/1990 Richmond
5,022,541 A 6/1991 White
5,054,404 A 10/1991 Melgers
5,069,408 A 12/1991 Bessinger
5,074,422 A 12/1991 Holtz
5,080,238 A 1/1992 Hochman
5,116,007 A 5/1992 Von Gunton et al.
5,127,342 A 7/1992 Taylor
5,161,701 A 11/1992 Berny
D331,873 S 12/1992 Finkelstein et al.
D333,059 S 2/1993 Cohn et al.
5,205,630 A 4/1993 Welch
5,221,014 A 6/1993 Welch et al.
5,230,492 A 7/1993 Zwart et al.
D339,704 S 9/1993 Cohn et al.
5,263,595 A 11/1993 Hilstolsky
5,265,740 A 11/1993 Hodsden et al.
5,269,419 A 12/1993 Aldeguer et al.
5,288,046 A 2/1994 Eklof et al.
5,297,486 A 3/1994 Herrmann et al.
5,303,645 A 4/1994 Meacham
5,305,898 A 4/1994 Merl
5,346,077 A 9/1994 Randall
5,350,074 A 9/1994 Rosenband
5,351,842 A 10/1994 Remmers
5,365,860 A 11/1994 Billington, III
5,390,803 A 2/1995 McAllister
5,405,114 A 4/1995 Dias
D358,321 S 5/1995 Tayar
5,415,302 A 5/1995 Carlson et al.
5,417,396 A 5/1995 Merl
5,423,251 A 6/1995 Kolvites et al.
5,437,426 A 8/1995 MacDonald
5,443,167 A 8/1995 Menaged et al.
5,454,638 A 10/1995 Bird et al.
5,456,435 A 10/1995 Sweeney
5,456,438 A 10/1995 Long
5,472,103 A 12/1995 Merl
5,477,971 A 12/1995 Howard
5,482,168 A 1/1996 Welch et al.
5,509,541 A 4/1996 Merl
5,518,127 A 5/1996 Warmack et al.
5,522,324 A 6/1996 Van Gelder et al.
5,531,168 A 7/1996 Towfigh
5,575,444 A 11/1996 Otema
5,592,886 A * 1/1997 Williams ..... A47B 57/52 108/108
5,605,238 A 2/1997 Jacobs
5,611,440 A 3/1997 Moller
5,613,449 A 3/1997 Pullman
5,641,081 A 6/1997 Merl
5,645,257 A 7/1997 Ward
5,647,650 A 7/1997 Daugherty et al.
5,655,740 A 8/1997 Lazarus
5,680,942 A 10/1997 McAllister et al.
5,695,163 A 12/1997 Tayar
5,715,957 A 2/1998 Merl
5,769,247 A 6/1998 Merl
5,794,902 A 8/1998 Henry et al.
5,797,501 A 8/1998 Von Gunten
5,797,503 A 8/1998 Stevens
5,806,820 A 9/1998 Simon
5,816,419 A * 10/1998 Lamson ..... A47B 57/045 211/150
5,833,083 A 11/1998 Miller
5,868,263 A 2/1999 McAllister et al.
5,884,567 A 3/1999 Bartz, Jr.
5,908,119 A 6/1999 Kump et al.
5,915,803 A 6/1999 Daugherty
5,921,190 A 7/1999 Wood
5,921,411 A 7/1999 Merl
5,921,414 A 7/1999 Burke et al.
D415,365 S 10/1999 Nicklas
5,970,887 A 10/1999 Hardy
5,979,677 A 11/1999 Simpson, II et al.
6,017,009 A 1/2000 Swartz et al.
6,019,331 A 2/2000 Hoogland et al.
6,024,333 A 2/2000 Raasch et al.
6,029,833 A 2/2000 Yeh
6,053,115 A 4/2000 Felton
6,062,401 A 5/2000 Hall et al.
6,082,690 A 7/2000 Durin et al.
6,109,461 A 8/2000 Kluge et al.
6,116,436 A 9/2000 Ferrucci et al.
6,129,224 A 10/2000 Mingers
6,158,599 A 12/2000 Lazarus
6,182,937 B1 2/2001 Sanderse
6,230,907 B1 5/2001 Stuart
6,253,687 B1 7/2001 McAllister
6,267,064 B1 7/2001 Ostertag et al.
6,269,906 B1 8/2001 Dockter et al.
6,302,283 B1 10/2001 Yeh
6,345,795 B1 2/2002 Bartz, Jr.
6,431,090 B1 8/2002 Davis et al.
D462,541 S 9/2002 Welch
6,460,946 B1 10/2002 Beukema
6,481,678 B1 11/2002 Chong
6,555,740 B2 4/2003 Roth et al.
6,584,916 B1 7/2003 Felton et al.
6,625,935 B1 9/2003 King et al.
6,659,295 B1 12/2003 De Land et al.
6,666,344 B1 12/2003 Schneider
6,675,725 B2 1/2004 Felton et al.
6,726,035 B2 4/2004 Zadak
RE38,517 E 5/2004 Pfeiffer et al.
6,848,589 B2 2/2005 Wood
6,918,499 B2 7/2005 De Land et al.
6,932,225 B2 8/2005 Rowe
6,935,518 B2 8/2005 Winig et al.
6,971,528 B2 12/2005 Chen
7,040,494 B2 5/2006 Harper
7,086,543 B2 8/2006 Remmers
7,128,223 B1 10/2006 Sarnoff et al.
7,147,114 B2 12/2006 Sarnoff et al.
7,150,361 B2 12/2006 Calleja
7,191,907 B2 3/2007 Conway
7,191,908 B2 3/2007 De Rijk
7,240,803 B2 7/2007 Stitchick et al.
7,258,317 B1 8/2007 Nagel
7,284,671 B1 10/2007 Doscher

(56) References Cited

U.S. PATENT DOCUMENTS

| | | | | |
|---|---|---|---|---|
| 7,311,211 | B2 | 12/2007 | Chung | |
| 7,350,649 | B1 * | 4/2008 | Martens | A47B 57/06 211/150 |
| 7,357,362 | B2 | 4/2008 | Yang et al. | |
| 7,387,212 | B2 | 6/2008 | Costa et al. | |
| 7,387,213 | B1 | 6/2008 | Smalley | |
| 7,401,705 | B2 | 7/2008 | Craft | |
| 7,404,533 | B1 | 7/2008 | Kologe | |
| 7,407,060 | B2 | 8/2008 | Swartz et al. | |
| 7,494,019 | B2 * | 2/2009 | Kessell | A47B 57/06 108/108 |
| 7,497,344 | B2 | 3/2009 | Chen | |
| 7,506,772 | B2 | 3/2009 | Chen | |
| 7,523,903 | B1 | 4/2009 | Rindoks et al. | |
| 7,568,436 | B2 | 8/2009 | McAllister et al. | |
| 7,654,497 | B1 | 2/2010 | Karan | |
| 7,677,514 | B1 | 3/2010 | Palmer | |
| 7,762,411 | B2 | 7/2010 | Hilburn et al. | |
| 78,104,387 | | 10/2010 | Ryberg | |
| 7,832,571 | B2 | 11/2010 | Felsenthal | |
| 7,900,783 | B2 | 3/2011 | Fernandez et al. | |
| 7,967,156 | B2 | 6/2011 | Hsu | |
| 7,967,268 | B2 | 6/2011 | Herron, III et al. | |
| 7,992,731 | B2 | 8/2011 | McAllister et al. | |
| 8,025,163 | B2 | 9/2011 | McAllister et al. | |
| 8,028,846 | B2 | 10/2011 | Peota et al. | |
| 8,087,521 | B2 | 1/2012 | Schwartzkopf et al. | |
| 8,113,678 | B2 | 2/2012 | Babcock et al. | |
| 8,118,181 | B2 | 2/2012 | Shinozaki | |
| 8,141,724 | B2 | 2/2012 | Northam et al. | |
| 8,152,119 | B2 | 4/2012 | Pfund et al. | |
| 8,235,339 | B2 | 8/2012 | Selvidge et al. | |
| 8,424,466 | B2 | 4/2013 | Botkin | |
| 8,468,844 | B2 | 6/2013 | Nagel et al. | |
| 8,584,873 | B2 | 11/2013 | Horn et al. | |
| 8,596,590 | B2 * | 12/2013 | McCoy | F16L 3/223 211/193 |
| 8,602,372 | B2 | 12/2013 | Yu et al. | |
| 8,646,624 | B2 | 2/2014 | Fernandez et al. | |
| D702,467 | S | 4/2014 | Huang et al. | |
| 8,967,576 | B2 | 3/2015 | Knoll et al. | |
| 9,119,471 | B2 | 9/2015 | Gonzalez et al. | |
| 9,173,506 | B2 | 11/2015 | Andersson et al. | |
| 9,277,814 | B2 | 3/2016 | Winker | |
| 9,339,108 | B2 | 5/2016 | Zang et al. | |
| 9,770,122 | B2 * | 9/2017 | Gonzalez | A47B 57/565 |
| D808,200 | S | 1/2018 | Davis et al. | |
| 9,883,755 | B2 * | 2/2018 | Gonzalez | A47B 57/565 |
| 10,104,987 | B2 * | 10/2018 | Gonzalez | A47B 57/565 |
| 2002/0104938 | A1 | 8/2002 | Simard | |
| 2003/0037712 | A1 | 2/2003 | Welch et al. | |
| 2003/0160012 | A1 | 8/2003 | Kanouchi et al. | |
| 2003/0234231 | A1 | 12/2003 | Rowe | |
| 2004/0020885 | A1 | 2/2004 | Newman | |
| 2004/0045919 | A1 | 3/2004 | Remmers | |
| 2004/0050814 | A1 | 3/2004 | Roush et al. | |
| 2004/0154498 | A1 | 8/2004 | Borgen et al. | |
| 2004/0159622 | A1 | 8/2004 | Craft et al. | |
| 2004/0173549 | A1 | 9/2004 | Herron, III et al. | |
| 2004/0182805 | A1 | 9/2004 | Harper | |
| 2005/0045787 | A1 | 3/2005 | Magnusson | |
| 2005/0056604 | A1 | 3/2005 | Chen | |
| 2005/0092706 | A1 | 5/2005 | Chang | |
| 2005/0103733 | A1 | 5/2005 | Saltzberg et al. | |
| 2005/0103734 | A1 | 5/2005 | Saltzberg et al. | |
| 2005/0127017 | A1 | 6/2005 | Kessel et al. | |
| 2005/0145147 | A1 | 7/2005 | Costa et al. | |
| 2005/0145588 | A1 | 7/2005 | Stitchick et al. | |
| 2005/0150850 | A1 | 7/2005 | Stitchick et al. | |
| 2005/0199568 | A1 | 9/2005 | Gay, II et al. | |
| 2006/0054577 | A1 | 3/2006 | Stating et al. | |
| 2006/0091088 | A1 | 5/2006 | McCoy | |
| 2006/0175495 | A1 | 8/2006 | Gregory | |
| 2006/0213849 | A1 | 9/2006 | Bienick | |
| 2007/0110511 | A1 | 5/2007 | Chen | |
| 2007/0114348 | A1 | 5/2007 | Nawrocki | |
| 2007/0138362 | A1 | 6/2007 | McAllister et al. | |
| 2007/0241072 | A1 | 10/2007 | Bryant et al. | |
| 2007/0295681 | A1 | 12/2007 | Colin | |
| 2008/0047914 | A1 | 2/2008 | Young | |
| 2008/0083685 | A1 | 4/2008 | Chen | |
| 2008/0128373 | A1 | 6/2008 | Chang et al. | |
| 2008/0142463 | A1 | 6/2008 | Johnson | |
| 2008/0179267 | A1 | 7/2008 | Johnson | |
| 2008/0217496 | A1 | 9/2008 | Wooten | |
| 2008/0237426 | A1 | 10/2008 | Walters | |
| 2009/0014400 | A1 | 1/2009 | Nawrocki | |
| 2009/0139943 | A1 | 6/2009 | Fernandez | |
| 2010/0032394 | A1 | 2/2010 | Wang | |
| 2010/0140202 | A1 | 6/2010 | Janis | |
| 2010/0155353 | A1 | 6/2010 | McAllister et al. | |
| 2010/0163504 | A1 | 7/2010 | Freeman | |
| 2010/0200716 | A1 | 8/2010 | White, III | |
| 2010/0327135 | A1 | 12/2010 | Selvidge et al. | |
| 2011/0168651 | A1 | 7/2011 | Stenftenagel et al. | |
| 2011/0220602 | A1 | 9/2011 | Chen | |
| 2012/0175330 | A1 | 7/2012 | Nicholls et al. | |
| 2012/0255924 | A1 | 10/2012 | Kologe | |
| 2012/0273447 | A1 | 11/2012 | Stitchick et al. | |
| 2012/0292271 | A1 | 11/2012 | Bevelacqua | |
| 2013/0020272 | A1 | 1/2013 | Kropveld | |
| 2013/0020452 | A1 | 1/2013 | Yu et al. | |
| 2013/0021391 | A1 | 1/2013 | Rui | |
| 2014/0263125 | A1 | 9/2014 | Gonzalez et al. | |
| 2015/0335155 | A1 | 11/2015 | Winker | |
| 2015/0366339 | A1 | 12/2015 | Gonzalez et al. | |
| 2016/0015174 | A1 | 1/2016 | Guizzardi | |
| 2017/0310090 | A1 | 10/2017 | Woodley et al. | |
| 2017/0332782 | A1 | 11/2017 | Gonzalez et al. | |
| 2017/0340108 | A1 | 11/2017 | Gonzalez et al. | |
| 2017/0340142 | A1 | 11/2017 | Gonzalez et al. | |

FOREIGN PATENT DOCUMENTS

| | | | |
|---|---|---|---|
| CN | 102131426 | A | 7/2011 |
| DE | 1138902 | | 10/1962 |
| DE | 2824605 | A1 | 12/1979 |
| DE | 9109395 | | 9/1991 |
| DE | 20215552 | U1 | 2/2003 |
| FR | 1515478 | | 3/1968 |
| GB | 608480 | A | 9/1948 |
| GB | 1025357 | | 1/1963 |
| GB | 1149568 | | 6/1967 |
| GB | 2194134 | | 3/1988 |
| KR | 101267731 | B1 | 5/2013 |
| WO | 9529613 | A1 | 11/1995 |
| WO | 03088782 | A2 | 10/2003 |
| WO | 2005046401 | | 5/2005 |
| WO | 2013071977 | A1 | 5/2013 |

OTHER PUBLICATIONS

"Cantilever Racks," All American Rack Company Warehouse Pallet Rack & Shelving (www.aarack.com/cantilever-racks/cantilever-racks/), produced by InterMetro Industries Corp in Case No. 13:18-cv-00116, *SPG International, LLC* v. *InterMetro Industries Corp* (2 pages).

"E-Z Walk-In Cooler/Freezer Shelving Systems," E-Z Shelving Systems, Inc., Merriam, KS, May 7, 2016, produced by InterMetro Industries Corp in Case No. 13:18-cv-00116, *SPG International, LLC* v. *InterMetro Industries Corp* (8 pages).

"E-Z Shelving Systems Basic Components," E-Z Shelving Systems, Inc., Merriam, KS, produced by InterMetro Industries Corp in Case No. 13:18-cv-00116, *SPG International, LLC* v. *InterMetro Industries Corp* (1 page).

"E-Z for 50 Years, Cantilever Shelving & Hardware," E-Z Shelving Systems, Inc., Merriam, KS, catalog, 2008, Produced by InterMetro Industries Corp in Case No. 13:18-cv-00116, *SPG International, LLC* v. *InterMetro Industries Corp* (4 pages).

"Cantilever," unreferenced image, produced by InterMetro Industries Corp in Case No. 13:18-cv-00116, *SPG International, LLC* v. *InterMetro Industries Corp* (1 page).

(56) References Cited

OTHER PUBLICATIONS

"Quick Change Cantilever System," New Age Industrial Corp., Inc., Norton, Kansas, produced by InterMetro Industries Corp in Case No. 13:18-cv-00116, *SPG International, LLC* v. *InterMetro Industries Corp* (2 pages).
"Pick Racks, Trucks & Cantilever Shelving," produced by InterMetro Industries Corp in Case No. 13:18-cv-00116, *SPG International, LLC* v. *InterMetro Industries Corp* (1 page).
"Metro Workspace Adjustable Workstations", InterMetro Industries Corporation, Wilkes-Barre, PA, 2001, produced by InterMetro Industries Corp in Case No. 13:18-cv-00116, *SPG International, LLC* v. *InterMetro Industries Corp* (4 pages).
"Sandwich Unit Refrigerator Model: SW48-12," Continental Refrigerator, Bensalem, PA, catalog, 2013, produced by InterMetro Industries Corp in Case No. 13:18-cv-00116, *SPG International, LLC* v. *InterMetro Industries Corp* (2 pages).
"Cantilever Metal Storage System," E-Z Shelving Systems, Inc., Merriam, KS, Product Guide Specification, Aug. 2011 (21 pages).
"Foodservice Cantilever Metal Storage System," E-Z Shelving Systems, Inc., Merriam, KS, Product Guide Specification, Aug. 2011 (19 pages).
"Shelving," New Age Industrial (www.newageindustrial.com:80/CategoryDetail.aspx?ISC_Category=Shelving), 2008 (1 page).
"New Age Industrial Aluminum Solutions," New Age Industrial Corporation, Inc., catalog, 2012 (72 pages).
"Sandwich Unit Refrigerator Model: SW48-12M-FB-D," Continental Refrigerator, Bensalem, PA, catalog, 2013 (2 pages).
"Sandwich Unit Refrigerator Model: SW48-12-FB," Continental Refrigerator, Bensalem, PA, catalog, 2013 (2 pages).
"Cantilever Shelving—New Age Industrial," (www.newageindustrial.com/PublicStore/Catalog/CategoryInfo.aspx?cid=191&sort=Name&itemsperpage=36&view=Grid&currentpage=1) (11 pages).
"New Age Industrial—Cantilevered Shelving," YouTube page, Apr. 16, 2011 (www.youtube.com/watch?v=Jm5aMXPcTsI) (2 pages).
Exhibit A, "Asserted Claims 1, 2, 3, 5, 7, 9, 11, 12, 14 and 16 of U.S. Pat. No. 9,883,755 are Invalid in View of Karnes," submitted by InterMetro Industries Corp in Case No. 13:18-cv-00116, *SPG International, LLC* v. *InterMetro Industries Corp,* (18 pages).
Exhibit B, "The Asserted Claims of U.S. Pat. No. 9,883,755 are Invalid Over Jensen et al. in View of Kessel et al.," submitted by InterMetro Industries Corp in Case No. 13:18-cv-00116, *SPG International, LLC* v. *InterMetro Industries Corp*, (26 pages).
Exhibit C, "The Asserted Claims of U.S. Pat. No. 9,883,755 are Invalid Over Jensen et al. in View of Mason," submitted by InterMetro Industries Corp in Case No. 13:18-cv-00116, *SPG International, LLC* v. *InterMetro Industries Corp*, (26 pages).
Exhibit D, "The Asserted Claims of U.S. Pat. No. 9,883,755 are Invalid Over Andersson et al. in View of Kessel et al.," submitted by InterMetro Industries Corp in Case No. 13:18-cv-00116, *SPG International, LLC* v. *InterMetro Industries Corp*, (26 pages).
Exhibit E, "The Asserted Claims of U.S. Pat. No. 9,883,755 are Invalid Over Andersson et al. in View of Mason," submitted by InterMetro Industries Corp in Case No. 13:18-cv-00116, *SPG International, LLC* v. *InterMetro Industries Corp*, (26 pages).
Exhibit F, "Asserted Claims 1-3, 5, 7-12, 14-16 and 18 of U.S. Pat. No. 9,883,755 are Invalid under 35 U.S.C. § 112," submitted by InterMetro Industries Corp in Case No. 13:18-cv-00116, *SPG International, LLC* v. *InterMetro Industries Corp*, (10 pages).
Defendant InterMetro Industries Corp.'s Invalidity Contentions, U.S. District Court, Middle District of Tennessee Nashville Division, *SPG International, LLC* v. *Intermetro Industries Corp*, Case No. 13:18-cv-00116, (28 pages).
International Search Report and Written Opinion received in International Patent Application No. PCT/US2014/026525 dated Jul. 28, 2014 (11 pages).
Extended European Search Report for Application No. 14775083.0 dated Feb. 15, 2017 (8 pages).
First Office Action and Search Report from the State Intellectual Property Office of the People's Republic of China for Application No. 201480024336.X dated Dec. 28, 2016 (16 pages).
Extended European Search Report for Application No. 14775083.0 dated Jun. 21, 2017 (9 pages).
Metro, "Metro Cantilevered Freestanding Shelving System," article (2001) 5 pages, www.metro.com.
Eagle Group, "Cantilever Shelving," article, EG7010 Rev. 3 (2005) 4 pages, www.eaglegrp.com.
Modern Equipment Company, Inc., "Meco Omaha Cantilever Rack, Buyers Guide" online brochure (2001) 12 pages.
Modern Equipment Company, Inc., "Instructions for Assembling Mew Omaha Series 2000 Medium—Heavy Duty Cantilever Rack" online brochure (2013) 6 pages, www.meco-omaha.com.
EZ Shelving Systems, Inc., "Manufacturer of Space-Saving Cantilever Shelving & Hardware," catalog (2005) pp. 1-8, Merriam, USA website: www.e-zshelving.com.
EZ Shelving Systems, Inc., "Manufacturer of Space-Saving Cantilever Shelving & Hardware," catalog (2008) pp. 1-4, Merriam, USA website: www.e-zshelving.com.
International Search Report and Written Opinion received in International Patent Application No. PCT/US2014/058308 dated Jan. 5, 2015 (9 pages).
First Office Action and Search Report from The State Intellectual Property Office of the People's Republic of China for Application No. 201480060558.7 dated Jun. 27, 2017 (10 pages).
Extended European Search Report for Application No. 14851078.7 dated Jun. 28, 2017 (8 pages).
Second Office Action and Search Report from the State Intellectual Property Office of the People's Republic of China for Application No. 201480024336.X dated Aug. 21, 2017 (8 pages).
U.S. Appl. No. 15/673,119, filed Aug. 9, 2017, In re Arturo Gonzalez et al., entitled "Support Bracket" (25 pages).
U.S. Appl. No. 15/678,909, filed Aug. 16, 2017, In re Arturo Gonzalez et al., entitled "Support Bracket" (23 pages).
Office Action received in U.S. Appl. No. 14/840,254, dated Sep. 29, 2017 (8 pages).
Office Action received in U.S. Appl. No. 15/673,119, dated Oct. 2, 2017 (14 pages).
Office Action received in U.S. Appl. No. 15/678,909, dated Oct. 6, 2017 (20 pages).
Complaint for Patent Infringement, U.S. District Court, Middle District of Tennessee Nashville Division, *SPG International, LLC* v. *Intermetro Industries Corp*, Case No. 13:18-cv-00116, filed Feb. 8, 2018 (6 pages).
Defendant's Amended Answer and Counterclaims, U.S. District Court, Middle District of Tennessee Nashville Division, *SPG International, LLC* v. *Intermetro Industries Corp*, Case No. 13:18-cv-00116, filed Apr. 5, 2018 (18 pages).
Limited Warranty and Assembly Instructions, Nexel Industries Inc., believed to be available to the public before Oct. 1, 2013, (3 pages).
"Cantilever Shelving System," catalog, Nexel Industries Inc., believed to be available to the public before Oct. 1, 2013, Nexelwire.com, (1 page).
"Corrosion Resistant Cantilever Rack," website, Global Industrial, Nov. 18, 2011, globalindustrial.com, (2 pages).
"Corrosion Resistant Cantilever Rack Upright," website, Global Industrial, Oct. 17, 2011, globalindustrial.com, (3 pages).
"Storage and Handling Equipment," catalog, Nexel Industries Inc., Jul. 24, 2010, http://www.nexelwire.com:80/catalog/, (1 page).
"Shelf Types," catalog, Nexel Industries Inc., Sep. 28, 2010, (58 pages).
Statement of Relevance with photo of shelving system asserted by Defendant in *SPG International, LLC* v. *Intermetro Industries Corp*, Case No. 3:18-cv-00116 as a cantilever shelving system made by Nexel Industries, Inc. and available to the public since at least about Oct. 2011, (2 pages).
Statement of Relevance with photos showing select components of a cantilever shelving system of Nexel Products, Inc., believed to be available to the public before Oct. 1, 2013, (11 pages).
"Button-On Cantilever Rack Specification," webpage, https://web.archive.org/web/20061019070526/http://www.jarke.com/pro . . . ; Jarke, Prospect Heights, IL, 2006, produced by InterMetro Industries Corp in Case No. 13:18-cv-00116, *SPG International, LLC* v. *InterMetro Industries Corp*, (3 pages).

(56) References Cited

OTHER PUBLICATIONS

"Cantilevered Shelving System—Heavy Duty Components," Eagle Group, Clayton, DE, specification sheet, 2010, produced by InterMetro Industries Corp in Case No. 13:18-cv-00116, *SPG International, LLC* v. *InterMetro Industries Corp*, (2 pages).
"Cantilever Shelving," Eagle Group, Clayton, DE, catalog, 2005, produced by InterMetro Industries Corp in Case No. 13:18-cv-00116, *SPG International, LLC* v. *InterMetro Industries Corp*, (4 pages).
"Chapter 3—Installing FlexWorks Accessories," Lista International Corporation, Holliston, MA, guide, 2000, produced by InterMetro Industries Corp in Case No. 13:18-cv-00116, *SPG International, LLC* v. *InterMetro Industries Corp*, (14 pages).
"FreedomRail Installation Guide," Organized Living, Cincinnati, OH, guide, 2009, produced by InterMetro Industries Corp in Case No. 13:18-cv-00116, *SPG International, LLC* v. *InterMetro Industries Corp*, (3 pages).
"HD Super Work Center With Overhead," InterMetro Industries Corporation, Wilkes-Bane, PA, specification sheet, 1999, produced by InterMetro Industries Corp in Case No. 13:18-cv-00116, *SPG International, LLC* v. *InterMetro Industries Corp*, (2 pages).
"Shelving and Shelving Solutions," Eagle Group, Clayton, DE, catalog, 2009, produced by InterMetro Industries Corp in Case No. 13:18-cv-00116, *SPG International, LLC* v. *InterMetro Industries Corp*, (16 pages).
"Material Handling and Industrial Storage Solutions," SPG International, LLC, Covington, GA, Catalog, 2010, produced py InterMetro Industries Corp in Case No. 13:18-cv-00116, *SPG International, LLC* v. *InterMetro Industries Corp*, (27 pages).
"Super Erecta Shelf Post—Type and Direct Wall Mounts," InterMetro Industries, Wilkes-Bane, PA, specification sheet, 2000, produced by InterMetro Industries Corp in Case No. 13:18-cv-00116, *SPG International, LLC* v. *InterMetro Industries Corp*, (2 pages).
"Wire Basket with Brackets 36" x 16," Global Equipment Company, Inc., https://web.archive.org/web/20120507140028/http://www.globalindustria\85; web page, 2012, produced by InterMetro Industries Corp in Case No. 13:18-cv-00116, *SPG International, LLC* v. *InterMetro Industries Corp*, (3 pages).
Extended European Search Report for Application No. 18156976.5, dated May 15, 2018, European Patent Office, produced by InterMetro Industries Corp in Case No. 13:18-cv-00116, *SPG International, LLC* v. *InterMetro Industries Corp*, (4 pages).
"Corrosion Resistant Cantilever Rack—Adjustable Width Uprights & Frame (Only)," Global Industrial, 2011, Port Washington, NY, produced by InterMetro Industries Corp in Case No. 13:18-cv-00116, *SPG International, LLC* v. *InterMetro Industries Corp.*, (12 pages).
"Cantilever Shelving Unit Assembly Instruction," Nexel Industries, instruction sheet, assumed publicly available prior to 2011, produced by InterMetro Industries Corp in Case No. 13:18-cv-00116, *SPG International, LLC* v. *InterMetro Industries Corp*, (2 pages).
"Freestyle Modular Cantilever Shelving System," SPG International, LLC, Covington, GA, specification, 2016, produced by InterMetro Industries Corp in Case No. 13:18-cv-00116, *SPG International, LLC* v. *InterMetro Industries Corp*, (9 pages).
International Search Report and Written Opinion received in International Patent Application No. PCT/US2014/058308, dated Jan. 5, 2015, produced by InterMetro Industries Corp in Case No. 13:18-cv-00116, *SPG International, LLC* v. *InterMetro Industries Corp*, (9 pages).
First Office Action and Search Report from the State Intellectual Property Office of the People's Republic of China for Application No. 201480060558.7, dated Jun. 27, 2017, produced by InterMetro Industries Corp in Case No. 13:18;v-00116, *SPG International, LLC* v. *InterMetro Industries Corp*, (10 pages).
Extended European Search Report for Application No. 14851078.7, dated Jun. 28, 2017, produced by InterMetro Industries Corp in Case No. 13:18-cv-00116, *SPG International, LLC* v. *InterMetro Industries Corp*, (8 pages).
U.S. Appl. No. 15/673,119, filed Aug. 9, 2017, Arturo Gonzalez et al., entitled "Support Bracket," produced by InterMetro Industries Corp in Case No. 13:18-cv-00116, *SPG International, LLC* v. *InterMetro Industries Corp*, (25 pages).
U.S. Appl. No. 15/678,909, filed Aug. 16, 2017, Arturo Gonzalez et al., entitled "Support Bracket," produced by InterMetro Industries Corp in Case No. 13:18-cv-00116, *SPG International, LLC* v. *InterMetro Industries Corp*, (23 pages).
Office Action received in U.S. Appl. No. 14/840,254, dated Sep. 29, 2017, produced by InterMetro Industries Corp in Case No. 13:18-cv-00116, *SPG International, LLC* v. *InterMetro Industries Corp*, (8 pages).
Office Action received in U.S. Appl. No. 15/673,119, dated Oct. 2, 2017, produced by InterMetro Industries Corp in Case No. 13:18-cv-00116, *SPG International, LLC* v. *InterMetro Industries Corp*, (14 pages).
Office Action received in U.S. Appl. No. 15/678,909, dated Oct. 6, 2017, produced by InterMetro Industries Corp in Case No. 13:18-cv-00116, *SPG International, LLC* v. *InterMetro Industries Corp*, (20 pages).
Extended European Search Report for Application No. 14775083.0, dated Feb. 15, 2017, produced by InterMetro Industries Corp in Case No. 13:18-cv-00116, *SPG International, LLC* v. *InterMetro Industries Corp*, (8 pages).
First Office Action and Search Report from the State Intellectual Property Office of the People's Republic of China for Application No. 21480024336.X, dated Dec. 28, 2016, produced by InterMetro Industries Corp in Case No. 13:18-cv-00116, *SPG International, LLC* v. *InterMetro Industries Corp*, (16 pages).
"Metro Cantilevered Freestanding Shelving System," InterMetro Industries Corp., article, 1993, Wilkes-Barre, PA, produced by InterMetro Industries Corp in Case No. 13:18-cv-00116, *SPG International, LLC* v. *InterMetro Industries Corp*, (5 pages).
"Material Handling and Industrial Storage Solutions," SPG International, LLC, Covington, GA, Catalog, 2010, (97 pages).
Defendant InterMetro Industries Corp.'s Supplemental Invalidity Contentions, U.S. District Court, Middle District of Tennessee Nashville Division, *SPG International, LLC*v. *InterMetro Industries Corp*, Case No. 13:18-cv-00116, Jul. 31, 2019 (29 pages).
Defendant InterMetro Industries Corp.'s Supplemental Invalidity Contentions—Exhibits A1-A2 "Asserted Claims 1, 2, 3, 5, 7, 9, 11, 12, 14 and 16 of U.S. Pat. No. 9,883,755 are Invalid in View of Karnes" U.S. District Court, Middle District of Tennessee Nashville Division, *SPG International, LLC*v. *InterMetro Industries Corp*, Case No. 13:18-cv-00116, Jul. 31, 2019 (20 pages).
Defendant InterMetro Industries Corp.'s Supplemental Invalidity Contentions—Exhibits B1-B2 "The Asserted Claims of U.S. Pat. No. 9,883,755 are Invalid Over Jensen et al. In View of Kessel et al. And Andersson et al." U.S. District Court, Middle District of Tennessee Nashville Division, *SPG International, LLC*v. *InterMetro Industries Corp*, Case No. 13:18-cv-00116, Jul. 31, 2019 (31 pages).
Defendant InterMetro Industries Corp.'s Supplemental Invalidity Contentions—Exhibits C1-C2 "The Asserted Claims of U.S. Pat. No. 9,883,755 are Invalid Over Jensen et al. In View of Mason and Andersson et al." U.S. District Court, Middle District of Tennessee Nashville Division, *SPG International, LLC*v. *InterMetro Industries Corp*, Case No. 13:18-cv-00116, Jul. 31, 2019 (31 pages).
Defendant InterMetro Industries Corp.'s Supplemental Invalidity Contentions—Exhibits D1-D2 "The Asserted Claims of U.S. Pat. No. 9,883,755 are Invalid Over Andersson et al. In View of Kessel et al." U.S. District Court, Middle District of Tennessee Nashville Division, *SPG International, LLC*v. *InterMetro Industries Corp*, Case No. 13:18-cv-00116, Jul. 31, 2019 (28 pages).
Defendant InterMetro Industries Corp.'s Supplemental Invalidity Contentions—Exhibits E1-E2 "The Asserted Claims of U.S. Pat. No. 9,883,755 are Invalid Over Andersson et al. In View of Mason" U.S. District Court, Middle District of Tennessee Nashville Division, *SPG International, LLC*v. *InterMetro Industries Corp*, Case No. 13:18-cv-00116, Jul. 31, 2019 (28 pages).
Defendant InterMetro Industries Corp.'s Supplemental Invalidity Contentions—Exhibit F "Asserted Claims 1-3, 5, 7-12, 14-16 and 18 of U.S. Pat. No. 9,883,755 are Invalid under 35 U.S.C. § 112" U.S. District Court, Middle District of Tennessee Nashville Divi-

(56) References Cited

OTHER PUBLICATIONS sion, *SPG International, LLC*v. *InterMetro Industries Corp*, Case No. 13:18-cv-00116, Jul. 31, 2019 (10 pages).
Defendant InterMetro Industries Corp.'s Supplemental Invalidity Contentions—Exhibits A1-A2 "Asserted Claims 1-3, 5, 7, 13, 17, 19, 20, 23, 25, 27, 33, 34 and 36 of U.S. Pat. No. 9,883,755 [sic] are Invalid in View of Karnes" U.S. District Court, Middle District of Tennessee Nashville Division, *SPG International, LLC*v. *InterMetro Industries Corp*, Case No. 13:18-cv-00116, Jul. 31, 2019 (25 pages).
Defendant InterMetro Industries Corp.'s Supplemental Invalidity Contentions—Exhibits B1-B3 "The Asserted Claims of U.S. Pat. No. 10,104,987 are Invalid Over Jensen et al. In View of Kessel et al. And Andersson et al." U.S. District Court, Middle District of Tennessee Nashville Division, *SPG International, LLC*v. *InterMetro Industries Corp*, Case No. 13:18-cv-00116, Jul. 31, 2019 (56 pages).
Defendant InterMetro Industries Corp.'s Supplemental Invalidity Contentions—Exhibits C1-C3 "The Asserted Claims of U.S. Pat. No. 10,104,987 are Invalid Over Jensen et al. In View of Mason and Andersson et al." U.S. District Court, Middle District of Tennessee Nashville Division, *SPG International, LLC*v. *InterMetro Industries Corp*, Case No. 13:18-cv-00116, Jul. 31, 2019 (56 pages).
Defendant InterMetro Industries Corp.'s Supplemental Invalidity Contentions—Exhibits D1-D3 "The Asserted Claims of U.S. Pat. No. 10,104,987 are Invalid Over Andersson et al. In View of Kessel et al." U.S. District Court, Middle District of Tennessee Nashville Division, *SPG International, LLC*v. *InterMetro Industries Corp*, Case No. 13:18-cv-00116, Jul. 31, 2019 (50 pages).
Defendant InterMetro Industries Corp.'s Supplemental Invalidity Contentions—Exhibits E1-E3 "The Asserted Claims of U.S. Pat. No. 10,104,987 are Invalid Over Andersson et al. In View of Mason" U.S. District Court, Middle District of Tennessee Nashville Division, *SPG International, LLC*v. *InterMetro Industries Corp*, Case No. 13:18-cv-00116, Jul. 31, 2019 (52 pages).
Defendant InterMetro Industries Corp.'s Supplemental Invalidity Contentions—Exhibit F "Asserted Claims 1-3, 5, 7-9, 12-20, 23-25, 27-30, 32-38, 40, and 43-48 of U.S. Pat. No. 10,104,987 are Invalid under 35 U.S.C. § 112" U.S. District Court, Middle District of Tennessee Nashville Division, *SPG International, LLC*v. *InterMetro Industries Corp*, Case No. 13:18-cv-00116, Jul. 31, 2019 (25 pages).
Defendant InterMetro Industries Corp.'s Invalidity Contentions, U.S. District Court, Middle District of Tennessee Nashville Division, *SPG International, LLC*v. *InterMetro Industries Corp*, Case No. 13:18-cv-00116, Dec. 21, 2018 (28 pages).
Defendant InterMetro Industries Corp.'s Invalidity Contentions—Exhibits A1-A2 "Asserted Claims 1-3, 5, 7, 13, 17, 19, 20, 23, 25, 27, 33, 34 and 36 of U.S. Pat. No. 9,883,755 [sic] are Invalid in View of Karnes" U.S. District Court, Middle District of Tennessee Nashville Division, *SPG International, LLC*v. *InterMetro Industries Corp*, Case No. 13:18-cv-00116, Dec. 21, 2018 (25 pages).
Defendant InterMetro Industries Corp.'s Invalidity Contentions—Exhibits B1-B3 "The Asserted Claims of U.S. Pat. No. 10,104,987 are Invalid Over Jensen et al. In View of Kessel et al." U.S. District Court, Middle District of Tennessee Nashville Division, *SPG International, LLC*v. *InterMetro Industries Corp*, Case No. 13:18-cv-00116, Dec. 21, 2018 (53 pages).
Defendant InterMetro Industries Corp.'s Invalidity Contentions—Exhibits C1-C3 "The Asserted Claims of U.S. Pat. No. 10,104,987 are Invalid Over Jensen et al. In View of Mason" U.S. District Court, Middle District of Tennessee Nashville Division, *SPG International, LLC*v. *InterMetro Industries Corp*, Case No. 13:18-cv-00116, Dec. 21, 2018 (52 pages).
Defendant InterMetro Industries Corp.'s Invalidity Contentions—Exhibits D1-D3 "The Asserted Claims of U.S. Pat. No. 10,104,987 are Invalid Over Andersson et al. In View of Kessel et al." U.S. District Court, Middle District of Tennessee Nashville Division, *SPG International, LLC*v. *InterMetro Industries Corp*, Case No. 13:18-cv-00116, Dec. 21, 2018 (50 pages).
Defendant InterMetro Industries Corp.'s Invalidity Contentions—Exhibits E1-E3 "The Asserted Claims of U.S. Pat. No. 10,104,987 are Invalid Over Andersson et al. In View of Mason" U.S. District Court, Middle District of Tennessee Nashville Division, *SPG International, LLC*v. *InterMetro Industries Corp*, Case No. 13:18-cv-00116, Dec. 21, 2018 (52 pages).
Defendant InterMetro Industries Corp.'s Invalidity Contentions—Exhibit F "Asserted Claims 1-3, 5, 7-9, 12-20, 23-25, 27-30, 32-38 40, and 43-48 of U.S. Pat. No. 10,104,987 are Invalid under 35 U.S.C. § 112" U.S. District Court, Middle District of Tennessee Nashville Division, *SPG International, LLC*v. *InterMetro Industries Corp*, Case No. 13:18-cv-00116, Dec. 21, 2018 (25 pages).

* cited by examiner

SHELVING SYSTEM

CROSS-REFERENCE TO RELATED APPLICATIONS

This application is a continuation of U.S. patent application Ser. No. 15/886,636 filed on Feb. 1, 2018, which is a continuation of U.S. patent application Ser. No. 15/675,368 filed on Aug. 11, 2017, which is a continuation of U.S. patent application Ser. No. 15/026,519 filed on Mar. 31, 2016, which is a U.S. National Phase entry of International Patent Application PCT/US2014/058308 filed on Sep. 30, 2014, which claims priority to U.S. Provisional Patent Application No. 61/885,480 filed on Oct. 1, 2013, and to U.S. Provisional Patent Application No. 61/885,969 filed on Oct. 2, 2013, the entire contents of each of which are incorporated herein by reference.

FIELD

The present invention relates to shelves, racks, and workstations, and more particularly to shelves, racks, and workstations that are supported by a wall or ceiling and cantilevered for supporting items or for supporting work surfaces.

SUMMARY

An important function of most shelving and rack systems and workstations is the ability to increase storage and working space. Limitations exist in the design and assembly of many conventional shelving systems, racks and workstations. These limitations are most apparent in highly competitive industries in which space, assembly and adjustment time, and reliability are at a premium. One such industry is the food service industry, where each of these factors plays a significant role in the success and profitability of a business. Therefore, although the present invention (and the problems that exist in conventional shelving systems, racks, and workstations) is particularly well-adapted for use in the food service industry, it should be noted that the present invention is applicable to and solves similar problems in any industry employing shelving systems, racks, and workstations. Examples of such industries include retail stores in which merchandise is displayed and stored, laboratories and shops where storage and work space are needed, and warehouses in which any type of product is organized and stored.

Increased utilization of floor and storage space are primary goals for most businesses, and can significantly impact profitability of such businesses. For example, work spaces and/or storage spaces are often important resources in the food service industry, retail businesses and warehouses, to name just a few different types of businesses where space may typically be limited for such purposes. Varying the sizes and layouts of work and storage spaces calls for varying types, kinds and sizes of shelves, racks, and workstations. These structures typically consist of vertical supports, horizontal storage and support structures, and connecting elements for connecting the horizontal storage and support structures to the vertical supports, which are supported on a floor or similar surface.

It is normally desirable for shelving systems and workstations to be inexpensive, modular, adjustable, easy to assemble and disassemble, easy to clean and reliable. Conventional shelving systems and workstations do not always satisfy such criteria or provide the optimal features necessary to accomplish the goals desired. Specifically, many conventional shelving systems and workstations are often expensive, difficult to clean, assemble, disassemble, and adjust. Also, conventional systems often lack the modularity necessary to meet a wide variety of environments or prove to be unreliable.

In many conventional shelving systems and workstations, shelves are welded or otherwise permanently attached to vertical support posts, making the shelving system or workstation a single integral structure (or defining large subassemblies in such shelving systems and workstations). This makes the shelving systems and workstations more difficult to move due to the size and weight of the integral assemblies or subassemblies. Also, by permanently attaching the shelves to support posts, the shelving systems and workstations can only be arranged in a single configuration. In other conventional shelving systems and workstations, assembly can be difficult and time consuming.

In light of the problems and limitations of the prior art described above, a need exists for shelving systems and workstations that are easy to clean, are easy and quick to assemble, provide an adjustable and reliable connection between shelves and vertical support posts, can support a relatively large amount of weight, and can be supported by a wall or ceiling, thereby freeing up valuable floor space for other purposes. Each preferred embodiment of the present invention achieves one or more of these results.

In one embodiment, a shelving system is provided which includes a plurality of horizontal support members, each horizontal support member having a length; a plurality of wall supports, each wall support including a first surface on which at least a portion of a horizontal support member rests; a plurality of brackets, each bracket attachable to the horizontal support members at different positions along the length of the horizontal support member; a plurality of vertical support members, each vertical support member coupled to at least one bracket; and a shelf attached to at least two of the plurality of vertical support members.

In another embodiment, a shelving system is provided which includes a plurality of horizontal support members, each horizontal support member having a length; a plurality of wall supports, each wall support including a first surface on which at least a portion of a horizontal support member rests; a plurality of brackets, each bracket attachable to the horizontal support members at different positions along the length of the horizontal support member; a plurality of vertical support members, each vertical support member coupled to at least one bracket; a ceiling support including a second surface on which at least a portion of a horizontal support member rests, the ceiling support including an upper plate and a lower plate coupled by a least one pin, wherein the second surface is coupled to the lower plate; and a shelf attached to at least two of the plurality of vertical support members.

Various aspects of the invention will become apparent by consideration of the detailed description and accompanying drawings

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
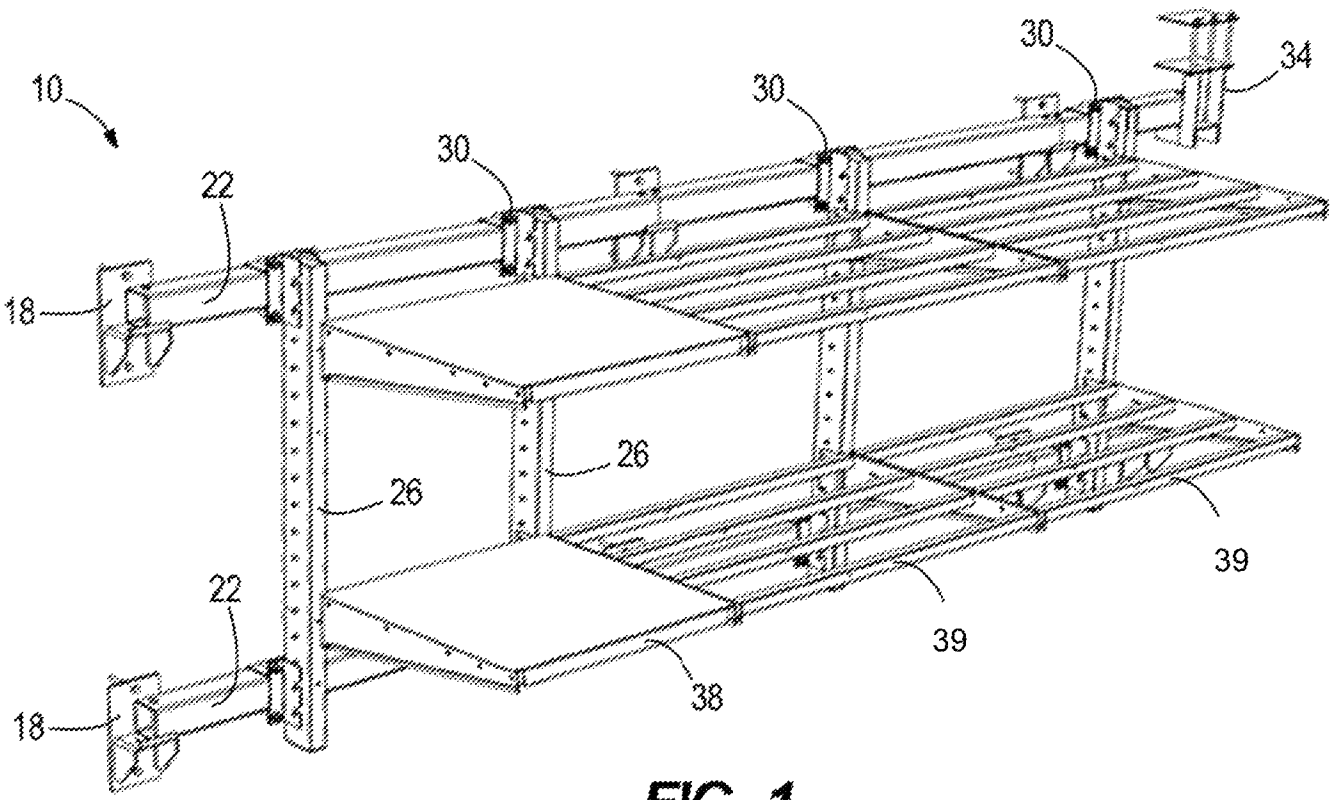
FIG. 1 is a perspective view of a shelving system.
Figure 2:
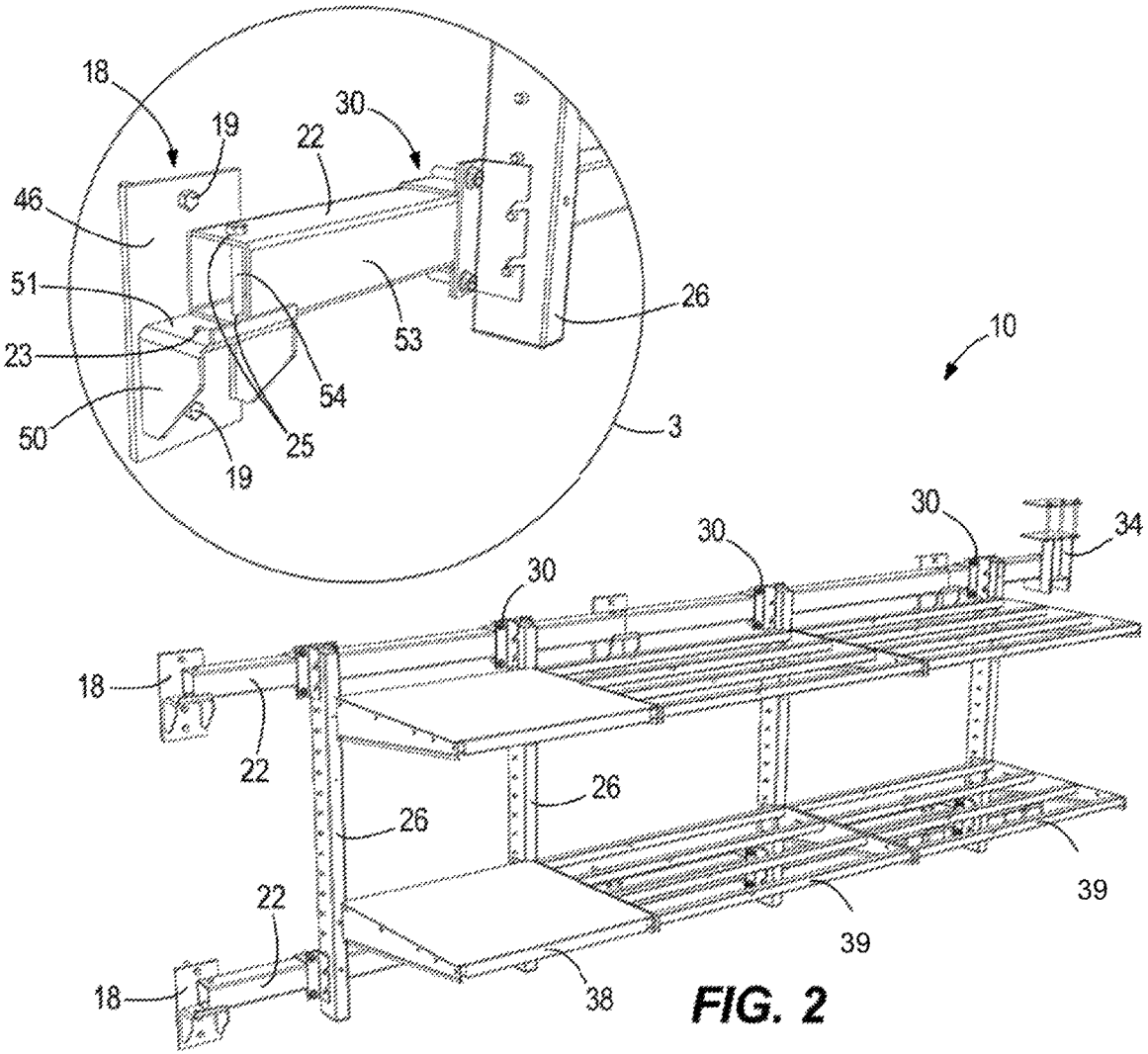
FIG. 2 includes an enlarged perspective view of a portion of the shelving system of FIG. 1.

FIGS. 1 and 2 show a shelving system 10 for supporting multiple shelves. In certain embodiments, the shelving system 10 may be positioned, for example, within a walk-in cooler or other refrigerated compartment or other types of compartments, rooms, or areas. In the illustrated embodiment, the shelving system 10 includes wall supports 18, first or horizontal support members 22, second or vertical support members 26, brackets 30, a ceiling support 34, and shelves 38. As used herein, the term "shelf" or "shelves" refers to any storage or support surface used to support product or other types of articles or upon which work can be performed.

Figure 3:
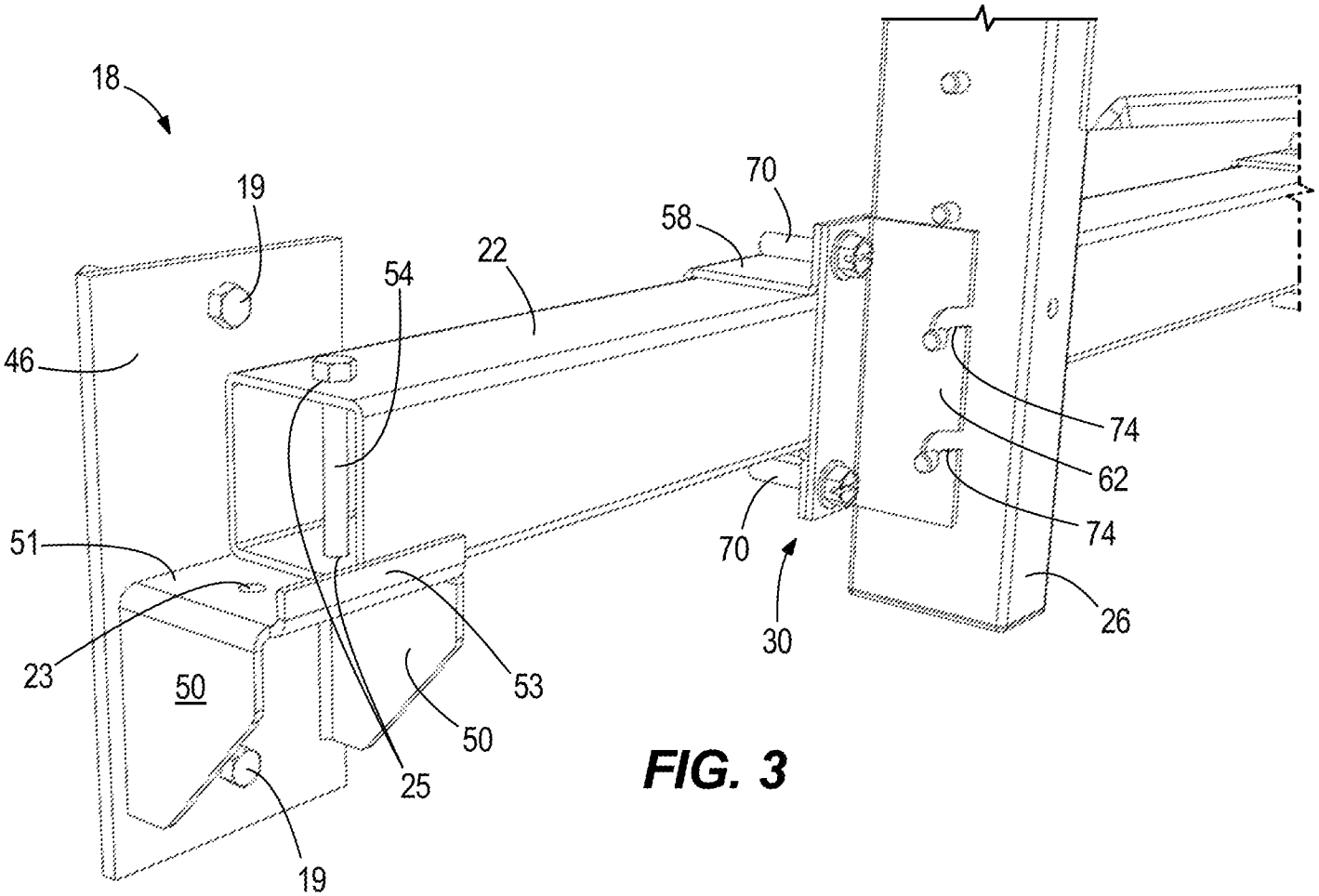
FIG. 3 is a perspective view of a wall support, a portion of a horizontal support member, a portion of a vertical support member, and a bracket.
Figure 4:
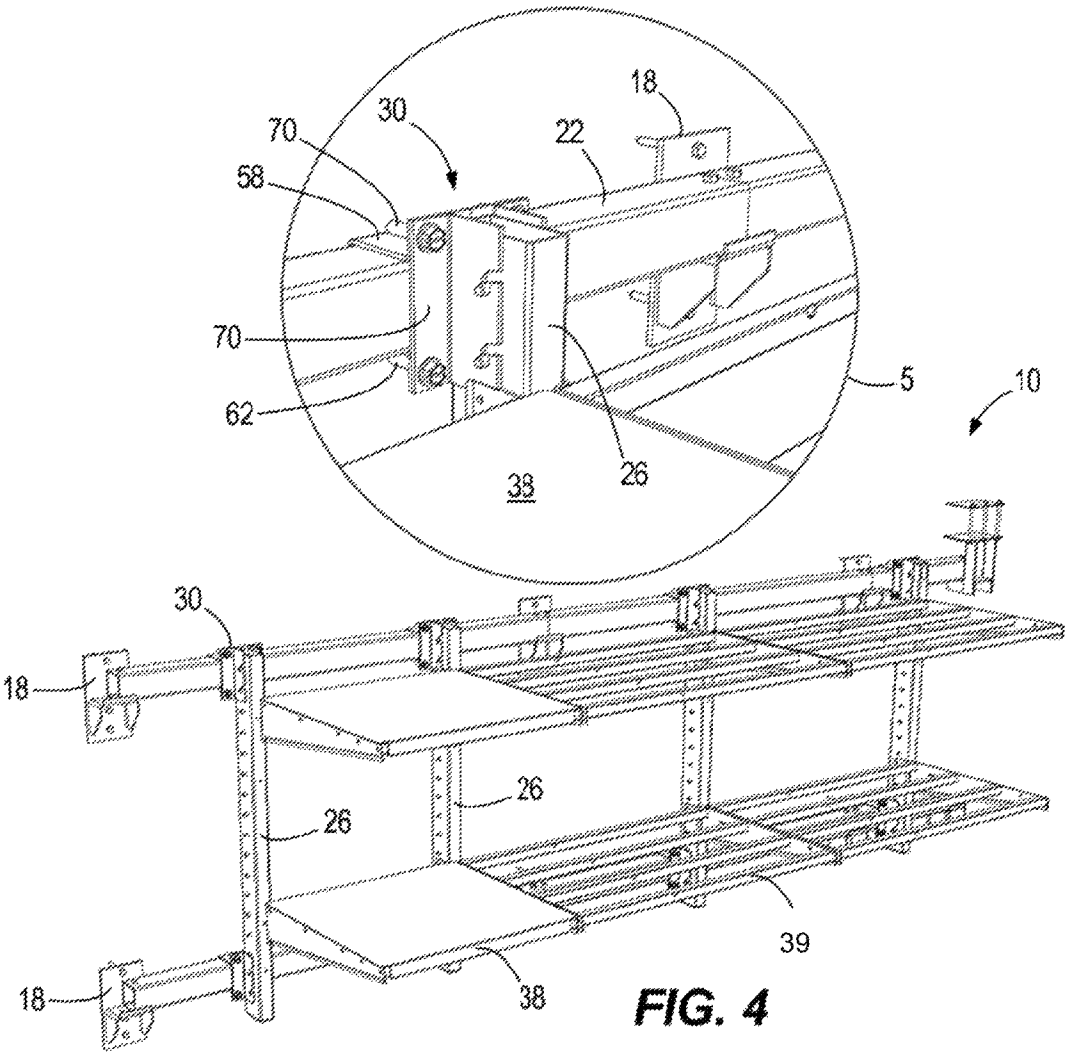
FIG. 4 includes an enlarged perspective view of a portion of the shelving system of FIG. 1.
Figure 5:
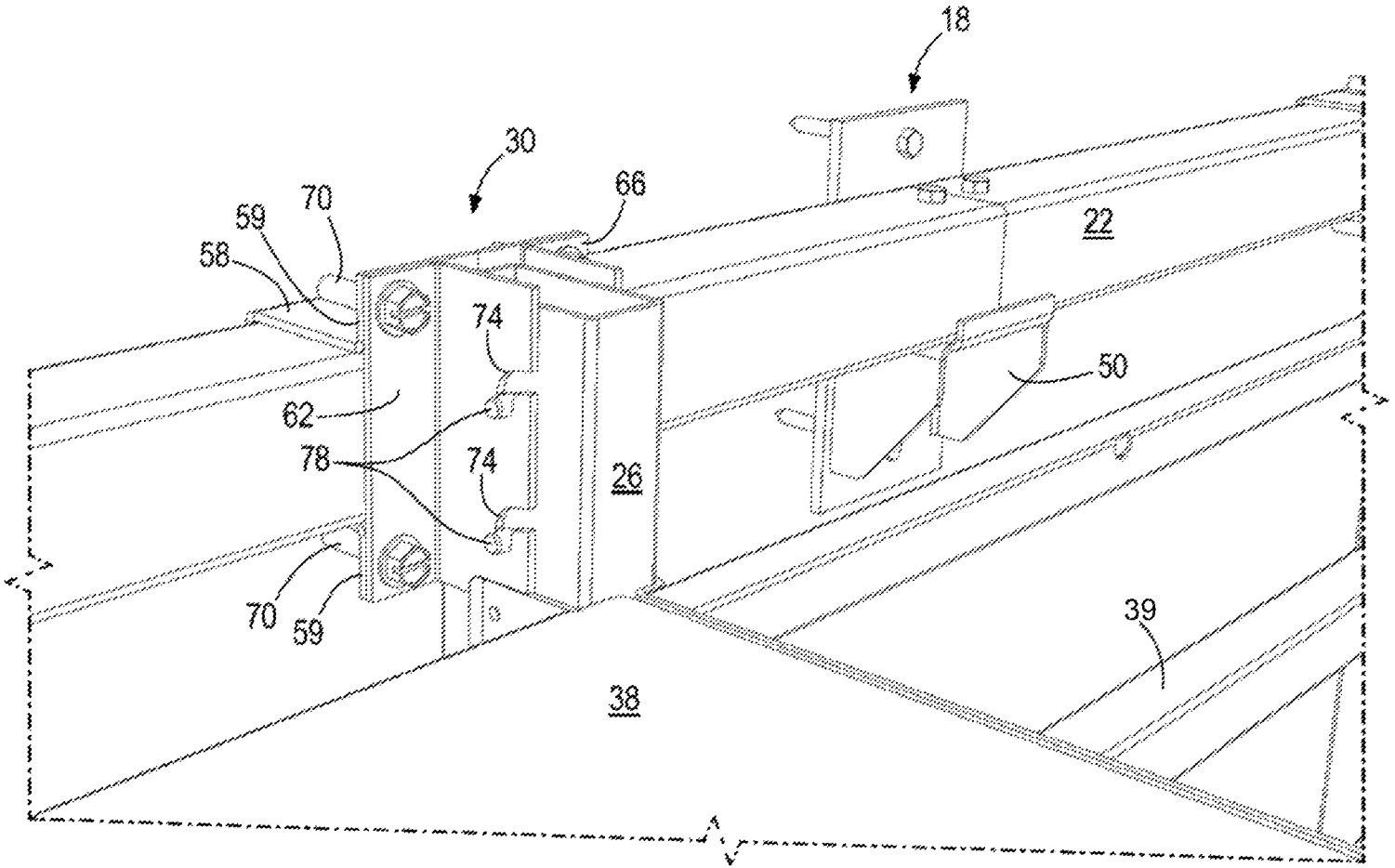
FIG. 5 is a perspective view of a portion of the horizontal support member, a bracket, a portion of a vertical support member, and a portion of a shelf.

As best shown in FIGS. 2 and 3, each of the wall supports 18 includes a plate 46 coupled to the surface of a wall (e.g., by a bolt or other fastener). Each wall support 18 includes a flange 50 extending outwardly from the plate 46. Plate 46 can be secured to a support surface such as a wall using, for example, fasteners 19 that extend through the plate and into the support surface (e.g. a wall). The flange 50 forms a surface or ledge 51 upon which the horizontal support members 22 rest. In the illustrated embodiment the ledge includes an optional lip 53 at the outer edge to securely hold the horizontal support members 22 in place on the ledge. In the illustrated embodiment, the horizontal support members 22 are fastened to the flange 50 (e.g., by a fastener such as a bolt or pin 54 extending through support member 22 and an aperture 23 that is provided in flange 50 and aligned apertures 25 that are provided in opposing upper and lower surfaces of the horizontal support member 22). In the illustrated embodiment, the horizontal support member 22 extends partially across the surface of flange 50, allowing an end of another horizontal support member 22 to be placed adjacent to the support member 22 shown in FIG. 3 and thereby to also be supported on the other portion of the surface of flange 50 as shown in FIGS. 4 and 5. Each horizontal support member 22 placed end-to-end on flange 50 is thus fastened to flange 50 by a bolt or pin 54 or other suitable fastener that extends through a flange aperture 23. Any number of horizontal support members 22 can be used to form shelving system 10 and provide a framework for vertical support members 26, as described below.

In addition, each bracket 30 is coupled to one of the horizontal support members 22. As shown in FIGS. 3-5, each bracket 30 includes a clamp 58 extending substantially around the top, rear, and bottom surfaces of horizontal support member 22, and includes a first clamping plate 62 and a second clamping plate 66 (FIG. 5). The clamp 58 includes upper and lower flanged portions 59 for coupling of the clamp 58 to the first clamping plate 62 and the second clamping plate 66 (FIG. 5). The clamp 58 is movable to different attachment positions along the horizontal support member 22 in order to accommodate different spacings for vertical support members 26, as described below. In one embodiment, the horizontal support member 22 includes detents or other marking or alignment mechanisms positioned at regular intervals (e.g., every six inches, every twelve inches, etc.) to indicate the spacing between adjacent brackets 30 and assist in positioning the vertical support members 26 relative to one another. Also, each clamping plate 62, 66 is fastened to the clamp 58 (e.g., by a pair of fasteners 70) to secure the bracket 30 to the horizontal support member 22 in a desired position along the length of the horizontal support member 22. The fasteners 70 can be loosened so that the bracket 30 can slide along the horizontal support member 22 to a desired position, where the fasteners 70 are again tightened to secure the bracket 30. Thus, it is desirable that the dimensions of clamp 58 are made such that tightening of fasteners 70 to join the clamp 58 to the first clamping plate 62 and the second clamping plate 66 causes bracket 30 to be tightened around the horizontal support member 22 to securely hold the clamp 58 in a desired position on the horizontal support member 22, whereas loosening the fasteners 70 allows the bracket 30 to slide along the horizontal support member 22. The fasteners 70 may be bolts which have matching nuts that are integrated into clamp 58 or which are separate parts from clamp 58.

The first clamping plate 62 and second clamping plate 66 may be two separate pieces, or the first clamping plate 62 and second clamping plate 66 may be part of a single piece (FIG. 9, left) which meets up with the clamp 58. The clamping plates 62, 66 are spaced apart from one another such that one of the vertical support members 26 may be positioned between the clamping plates 62, 66. When the first clamping plate 62 and second clamping plate 66 are part of a single piece, this may facilitate maintaining the correct size opening into which the vertical support member 26 fits between the first clamping plate 62 and second clamping plate 66. Each clamping plate 62, 66 includes an outwardly-extending flange 63, 67, respectively (see FIG. 9), each flange 63, 67 including multiple grooves 74 to receive pins 78 that extend outwardly from opposing sides of vertical support members 26.

In the illustrated embodiment, each vertical support member 26 is formed as a closed or box channel frame having a rectangular cross-section. In other embodiments (FIGS. 8 and 9), the vertical support member **26*b* is formed as an open or U-shaped channel. Each vertical support member 26 includes multiple pins 78 extending outward from opposing sides of the vertical support member 26. The pins 78 may extend through the vertical support member 26 or may simply project from the outer surfaces of the vertical support member 26. The ends of the pins 78 are positioned within the grooves 74 to secure the vertical support member 26 relative to the bracket 30. Thus, the bracket 30 serves to join the horizontal support members 22 to the vertical support members 26** in an adjustable manner.

Figure 8:
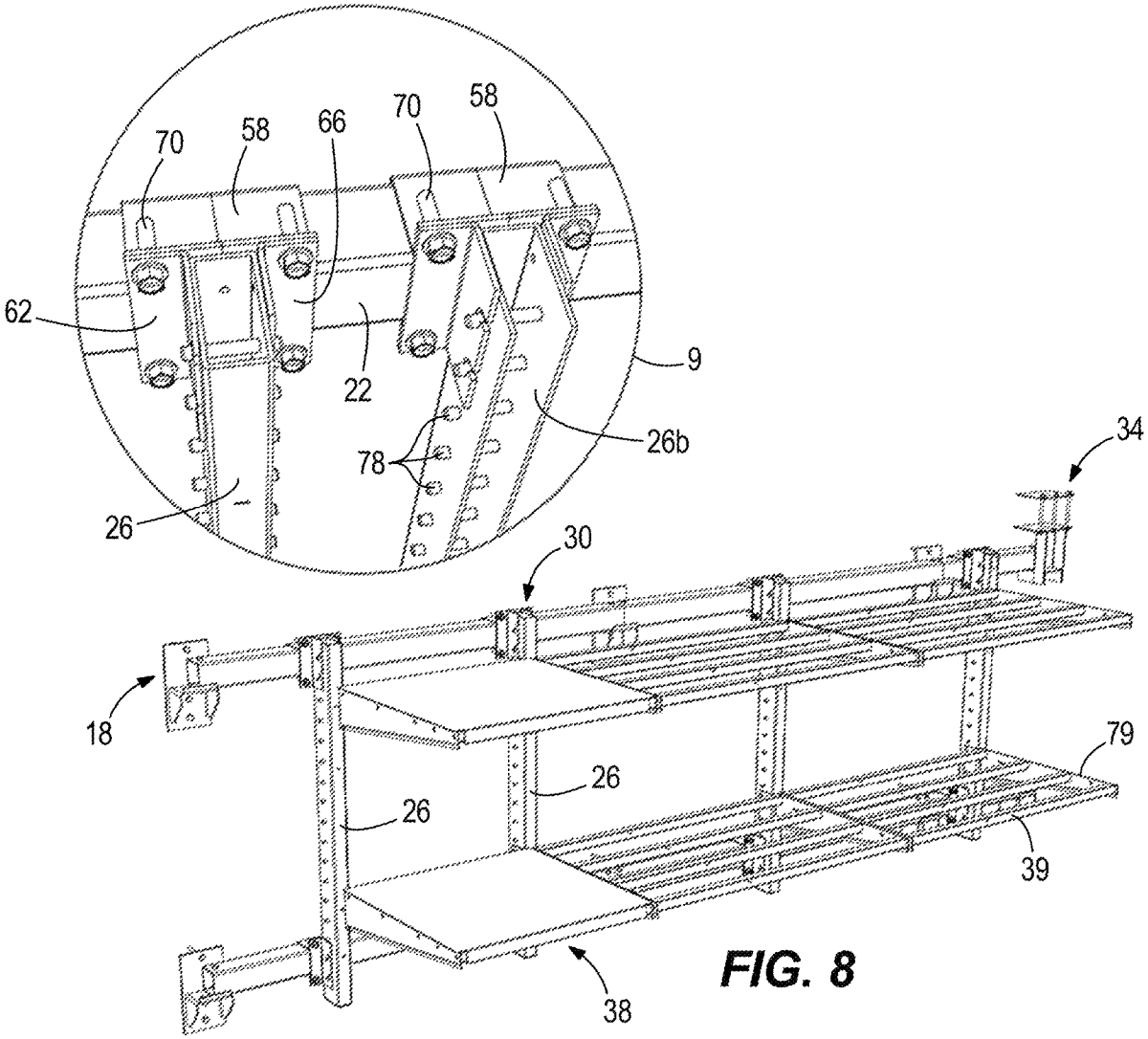
FIG. 8 includes an enlarged perspective view of a portion of the shelving system of FIG. 1.
Figure 9:
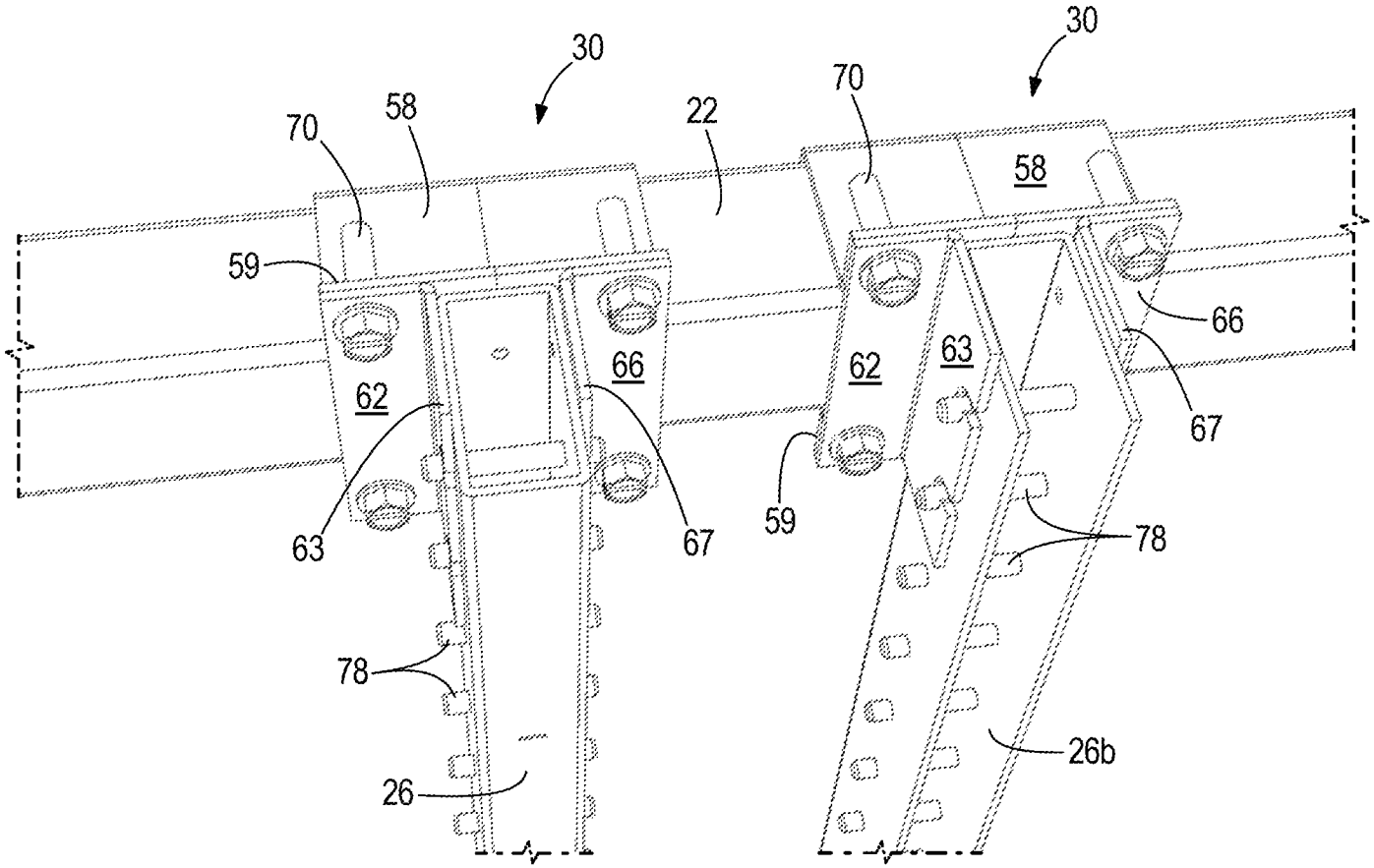
FIG. 9 illustrates a vertical support member according to one embodiments and a vertical support member according to another embodiment.

In a preferred embodiment, the pins 78 are mounted incrementally along the vertical support members 26. The pins 78 can be mounted at any regular or irregular distance from one another along any length or lengths of the vertical support member 26. However, in some preferred embodiments, the pins 78 are mounted at regular intervals along the majority of the support member's length. The pins 78 preferably extend laterally through the vertical support members 26 as shown in FIGS. 8-9. Specifically, each pin 78 is preferably a single piece that extends laterally through the support member 26 and has a portion of the pin 26 protruding laterally from both opposing sides of the member 26 (i.e., protruding from the left and right side surfaces of the support member 26 with respect to a viewing position in front of and facing the shelving system). Preferably, each pin 78 is welded to the vertical support member 26 on the left side or the right side or, more preferably, on both the left and right side. Although the pins 78 are preferably welded to both lateral sides of the support member 26, it should be noted that pins 78 extending through and past both opposing sides of the vertical support member 26 can be secured to member 26 in a number of other manners, including without limitation, by being press-fit or by otherwise having an interference fit within apertures on both opposing sides of member 26 or by being fastened to member 26 with one or more fasteners.

With reference to FIGS. 1, 2, 5, 6, and 8, the shelving system 10 preferably includes one or more shelves 38 having any size desired. In some preferred embodiments (including those shown in the figures), the shelves 38 are mounted to the vertical support members 26 by way of the support pins 78 as will be discussed below. A preferred embodiment of a shelf 38 used in shelving system 10 is illustrated in FIGS. 1, 2, 5, and 6. However, it should be noted that other shelves 38 having different sizes and shapes can employ the same features described hereafter, or shelves of different constructions may also be used in shelving system 10. In some preferred embodiments, the shelf 38 is a single integral piece having one or more cross members 39 and side braces 79. The cross members 39 preferably extend between the side braces 79 and provide a support surface for the shelf 38. Alternatively, the side braces 79 can be connected by a frame, sheet, series of bars or poles, mesh, screen, or any other element extending between the side braces 79 for purposes of supporting weight, for supporting surface covers upon which to work or store and display articles, and/or for securing the side braces 79 with respect to one another. In one embodiment, the side braces 79 may be attached to the vertical support members 26 by means of pins 78 to attach shelves 38 or like support structures or surfaces to the vertical support members 26, as described in U.S. Pat. No. 7,494,019, filed Apr. 16, 2003, the entire contents of which is incorporated herein by reference. Thus, shelves 38 may be mounted to vertical support members 26 at a desired height along the member. The side braces 79 may be separate components on which the shelves 38 are disposed, or the side braces 79 may be integrated with the shelves 38 as a single component.

Figure 6:
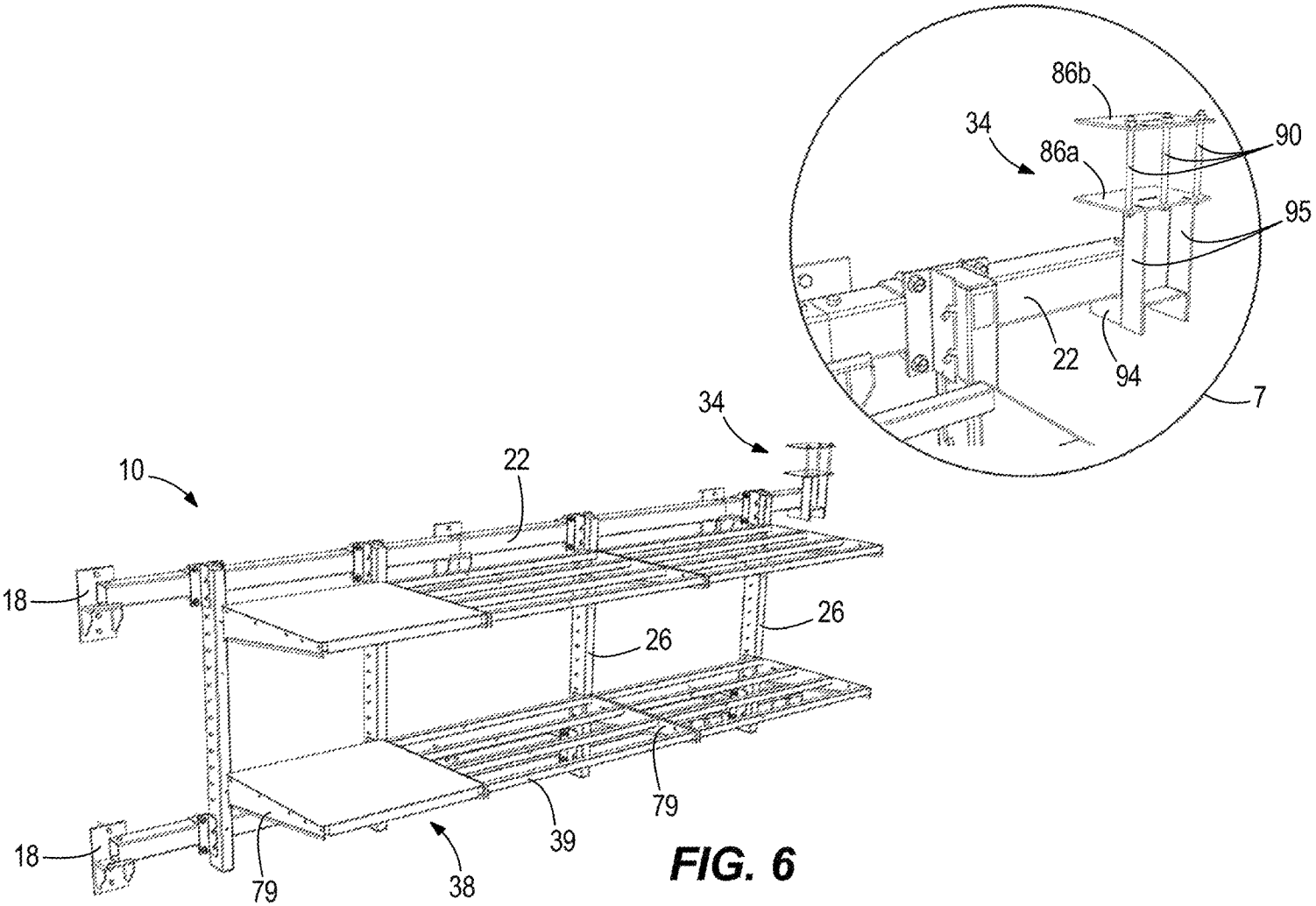
FIG. 6 includes an enlarged perspective view of a portion of the shelving system of FIG. 1.
Figure 7:
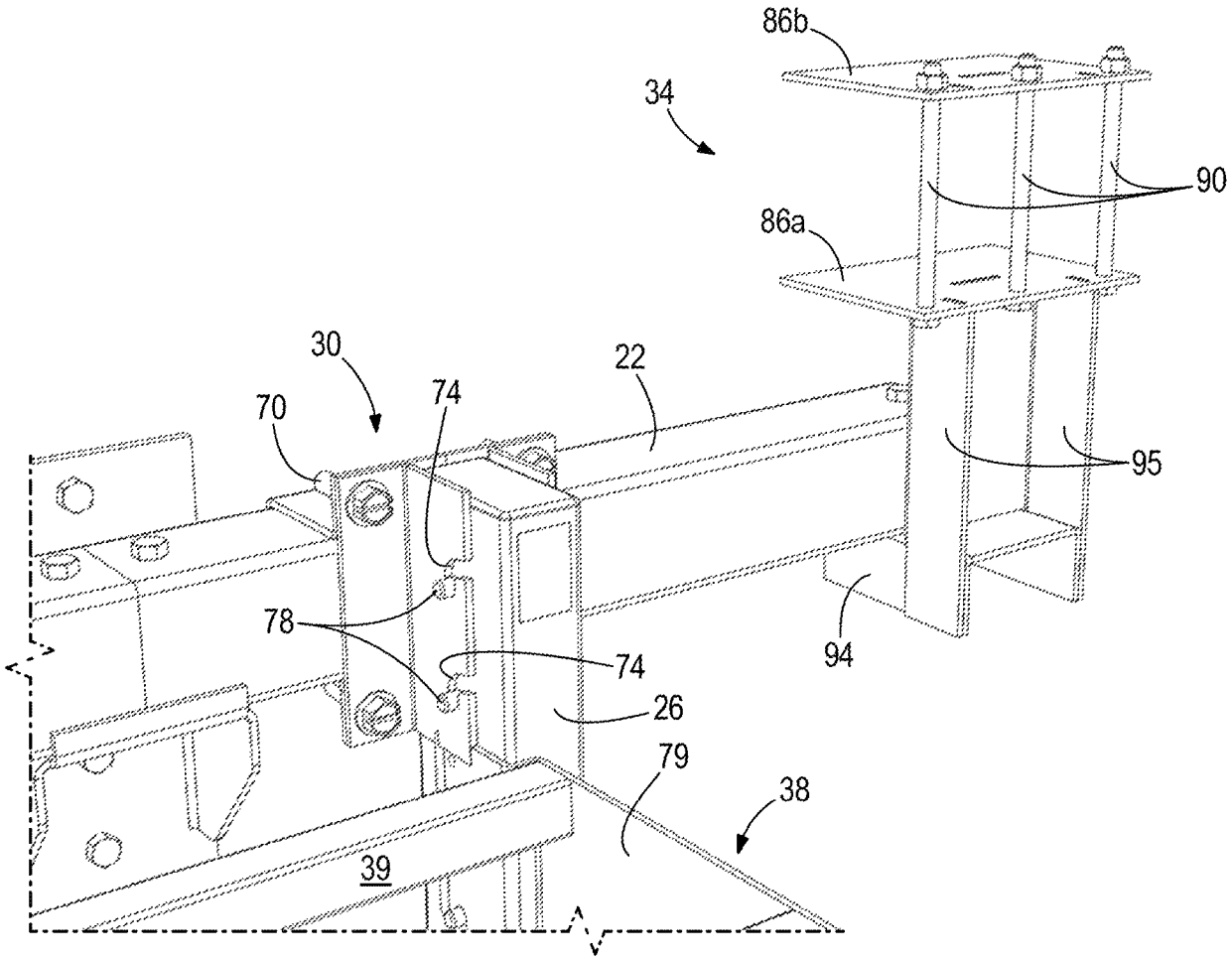
FIG. 7 is a perspective view of a portion of a shelving system including a ceiling support.

The side braces 79 may include multiple grooves, projections, or hooks (e.g. as shown and described in FIGS. 6-7 and col. 9:5-46 of U.S. Pat. No. 7,494,019, the entire contents of which is incorporated herein by reference) which engage with the pins 78. As explained above, brackets 30 can be attached to horizontal support members 22 at different positions along the horizontal support member 22 to allow a user to change the spacing between adjacent vertical supports 26 and account for variations in the width of the shelves 38. Also, the pins 78 allow for conventional shelves to be used in conjunction with the shelving system 10. Examples of such a shelving system are described in U.S. Pat. No. 7,494,019, filed Apr. 16, 2003, and U.S. Pat. No. 5,592,886, filed Jan. 31, 1994, the entire contents of both of which are incorporated herein by reference. Of course, other means of attaching shelves 38 to vertical support members 26 can be employed as known by those having ordinary skill in the art.

As shown in FIGS. 6 and 7, the ceiling support 34 is coupled to an end of one of the horizontal support members 22. The ceiling support 34 includes a pair of parallel, spaced apart horizontal plates 86*a*, 86*b*. A lower plate 86*a* is positioned adjacent an interior surface of a ceiling (not shown) of a room or compartment in which the shelving system 10 is located. An upper plate 86*a* is positioned above the ceiling of the room or compartment, adjacent an outer surface above the ceiling, thereby distributing force from the shelving system 10 over a wider area. One or multiple pins 90 extend through the space and ceiling between the plates 86*a*, 86*b*, coupling the plates 86*a*, 86*b* together. In addition, the lower plate 86*a* has attached thereto a ledge or channel 94 which is connected to the lower plate 86*a* by a pair of extensions 95. The ledge or channel 94 extends below the lower plate 86*a* and supports an end of at least one of the horizontal support members 22; one or more bolts or pins may be used to secure the horizontal support member 22 to the ledge or channel 94. The ledge or channel 94 may be located at various distances from the lower plate 86*a*, for example by providing extensions 95 of different lengths. The ceiling support 34 provides additional support and versatility for configuring shelving system 10. For example, the ceiling support 34 is useful when the shelving system 10 is mounted on a wall with a horizontal support member 22 being sufficiently close to the ceiling to allow use of the ceiling support 34, particularly in situations in which the walls of the compartment are not load-bearing, e.g. in a walk-in refrigerator or freezer. As used herein, a ceiling refers to any overhead or upper surface of a room, compartment, or area. The wall supports 18 may also help to stabilize and maintain alignment of the horizontal support members 22.

To the extent that the vertical support members 26 are supported by a wall or a ceiling of a compartment, this permits the floor to remain generally unobstructed. The load on the shelves is supported by the wall and/or ceiling in a cantilevered configuration, and the shelves 38 can be positioned above the level of the floor to permit free access to the floor space. In some embodiments, the shelving system 10 can be used alone or in conjunction with a freestanding shelving system and may also include an attachment to transfer some or all of the load to the floor. The shelving system 10 may also incorporate features of a freestanding shelving system such as those shown in U.S. Pat. No. 7,494,019, the entire contents of which is incorporated herein by reference.

By employing the wall and/or ceiling mounted horizontal members 22 to support vertical members 26, as described above, a number of embodiments of the present invention provide a workstation or a shelving or rack system that is highly adjustable, modular, and adaptable to a large number of applications, spaces, and environments, freeing up valuable floor space for other uses or purposes. In the various embodiments described above and illustrated in the figures, the use of vertical support members 26 that can be attached at a variety of desired positions along the length of horizontal support members 22, and having pins 78 extending from opposite sides thereof, enables a user to accommodate shelves 38 of different sizes and mount adjacent shelves 38 on both sides of the vertical support members 26 in a variety of configurations. Thus, once wall supports 18 and optional ceiling supports 34 have been installed, various arrangements of horizontal support members 22 and vertical support members 26 can be provided in order to accommodate a given arrangement of shelves 38. The arrangement of shelves 38 can readily be changed by rearranging the horizontal support members 22 and vertical support members 26 without having to mount any additional supports in the wall or ceiling. This versatility, coupled with the more reliable and simpler shelf mounting arrangement of the present invention, provides a number of advantages as discussed above.

Thus, the invention may provide, among other things, a shelving system. Although the invention has been described in detail with reference to certain independent embodiments, variations and modifications exist within the scope and spirit of one or more independent aspects of the invention as described. Various features and advantages of the invention are set forth in the following claims.

What is claimed is:

1. A shelving system including a shelf having first and second opposed sides and a weight supporting surface for storing or displaying articles, the shelving system comprising:

first and second vertical support posts, each vertical support post having a height and first and second opposed exterior surfaces that face away from each other and a third exterior surface that is orthogonal to and couples the first and second opposed exterior surfaces; and a plurality of support pins fixed to each of the first and second vertical support posts and spaced along the height of each of the first and second vertical support posts and extending away and outwardly from at least one of the surfaces of the first and second opposed exterior surfaces on each of the first and second vertical support posts; and first and second support brackets, each of the first and second support brackets comprising a pair of spaced-apart opposed flanges and a surface orthogonal to and in contact with the pair of spaced-apart opposed flanges, wherein the first support bracket is configured such that in an assembled state of the shelving system the pair of spaced-apart opposed flanges of the first support bracket is coupled to the first vertical support post with one flange of the pair of spaced-apart opposed flanges positioned in contact with the first exterior surface of the first vertical support post and the other flange of the pair of spaced-apart opposed flanges is positioned in contact with the second exterior surface of the first vertical support post, wherein each flange of the pair of spaced-apart opposed flanges includes at least one aperture configured to releasably engage one of the plurality of support pins on the first vertical support post, each aperture formed as a slot with an open end, wherein the first support bracket is configured such that in the assembled state of the shelving system the surface that is orthogonal to and in contact with the pair of spaced-apart flanges contacts and extends across the third exterior surface of the first vertical support post, and wherein the first support bracket is configured such that in the assembled state of the shelving system the first support bracket cooperates with the first vertical support post to support the first side of the shelf on a support surface, and wherein the second support bracket is configured such that in the assembled state of the shelving system the second support bracket is coupled to and cooperates with the second vertical support post to support the second side of the shelf on a support surface; and first and second cooperating brackets, each of the first and second cooperating brackets comprising a coupling portion configured to removably couple the shelf with one of the first and second vertical support posts and a support portion connected to the coupling portion and configured to support one of the first and second sides of the shelf, wherein the coupling portion of the first cooperating bracket is configured such that movement of the first cooperating bracket in a direction parallel to a longitudinal axis of the first vertical support post to couple the first cooperating bracket to the first support bracket constrains rotational movement of the first cooperating bracket relative to the first support bracket, wherein the first cooperating bracket is configured such that in the assembled state of the shelving system the first cooperating bracket is positioned between the first support bracket and the first side of the shelf to support the first side of the shelf, couples the shelf to the first vertical support post, and spaces the first side of the shelf from the first support bracket, wherein the first cooperating bracket is configured such that in the assembled state of the shelving system the support portion supports a portion of the shelf and the coupling portion transmits a loading force from the first side of the shelf to the first vertical support post, wherein the first cooperating bracket is configured such that in the assembled state of the shelving system the first cooperating bracket does not extend above a top side of the first support bracket and the first cooperating bracket hinders movement of the shelf in a direction orthogonal to a plane coincident with the third exterior surface of the first vertical support post, wherein the second cooperating bracket is configured such that in the assembled state of the shelving system the second cooperating bracket is positioned between the second support bracket and the second side of the shelf to support the second side of the shelf, couples the shelf to the second vertical support post, and spaces the shelf from the second support bracket, and wherein in the assembled state of the shelving system the weight supporting surface of the shelf does not extend above a top side of each of the first and second support brackets.

2. The shelving system of claim 1, wherein the shelf is a first shelf and the shelving system further comprises a second shelf and a third cooperating bracket configured such that in the assembled state of the shelving system the third cooperating bracket is positioned relative to the first support bracket to support the second shelf on the first vertical support post at a same height as the first shelf.

3. The shelving system of claim 1, wherein the first support bracket is configured such that in the assembled state of the shelving system the first support bracket couples the first vertical support post to the support surface and the second support bracket is configured such that in the assembled state of the shelving system the second support bracket couples the second vertical support post to the support surface.

4. The shelving system of claim 1, wherein the coupling portion and the support portion of each of the first and second cooperating brackets are formed from a single piece of material.

5. The shelving system of claim 1, wherein each of the first and second cooperating brackets is configured such that in the assembled state of the shelving system the shelf is fixed to the support portion of each of the first and second cooperating brackets.

6. The shelving system of claim 1, wherein each of the first and second cooperating brackets is configured such that in the assembled state of the shelving system a bottom side of the shelf is positioned above a bottom side of each of the first and second cooperating brackets.

7. The shelving system of claim 1, wherein each flange of the pair of spaced-apart opposed flanges of the first support bracket includes a plurality of apertures, each aperture formed as a slot with an open end and configured to releasably engage one of the plurality of support pins on the first vertical support post.

8. The shelving system of claim 1, wherein the flanges of the pair of spaced-apart opposed flanges of the first support bracket are separable.

9. The shelving system of claim 1, wherein the first cooperating bracket includes a flange having at least one aperture configured to releasably engage one of the plurality of support pins on the first vertical support post and the second cooperating bracket includes a flange having at least one aperture configured to releasably engage one of the plurality of support pins on the second vertical support post.

10. The shelving system of claim 1, wherein the coupling portion of each of the first and second cooperating brackets comprises a pair of spaced-apart fingers.

11. The shelving system of claim 10, wherein the coupling portion of each of the first and second cooperating brackets includes a body and the pair of spaced-apart fingers extends from the body.

12. The shelving system of claim 10, wherein the third exterior surface of the first vertical support post defines a plane and the first cooperating bracket is configured such that upon movement of the pair of spaced-apart fingers parallel to the longitudinal axis of the first vertical support post to couple the first cooperating bracket to the first support bracket, the first cooperating bracket is constrained from movement orthogonal to the plane defined by the third exterior surface of the first vertical support post, and wherein the third exterior surface of the second vertical support post defines a plane and the second cooperating bracket is configured such that upon movement of the pair of spaced-apart fingers parallel to a longitudinal axis of the second vertical support post to couple the second cooperating bracket to the second support bracket, the second cooperating bracket is constrained from movement orthogonal to the plane defined by the third exterior surface of the second vertical support post.

13. The shelving system of claim 1, wherein each of the first and second vertical support posts further comprises a first transition surface between the first exterior surface and the third exterior surface and a second transition surface between the second exterior surface and the third exterior surface.

14. The shelving system of claim 1, wherein each flange of the pair of spaced-apart opposed flanges of the first support bracket has an equal height and the surface of the first support bracket that is orthogonal to and extends between the pair of spaced-apart opposed flanges has a height equal to the height of the flanges.

15. The shelving system of claim 1, wherein the coupling portion of each of the first cooperating bracket and second cooperating bracket comprises a pair of spaced-apart fingers and a notch associated with each finger of the pair of spaced-apart fingers, and wherein the pair of spaced-apart fingers and notches of the first cooperating bracket are configured such that in the assembled state of the shelving system the coupling portion of the first cooperating bracket constrains the first cooperating bracket from rotation relative to the first support bracket and the pair of spaced-apart fingers and notches of the second cooperating bracket are configured such that in the assembled state of the shelving system the coupling portion of the second cooperating bracket constrains the second cooperating bracket from rotation relative to the second support bracket.

16. The shelving system of claim 1, wherein the first cooperating bracket is separable from the first support bracket.

17. A shelving system including a shelf having first and second opposed sides and a weight supporting surface for storing or displaying articles, the shelving system comprising:

first and second vertical support posts, each vertical support post having a height and first and second opposed exterior surfaces that face away from each other and a third exterior surface that is orthogonal to and couples the first and second opposed exterior surfaces; and a plurality of support pins fixed to each of the first and second vertical support posts and spaced along the height of each of the first and second vertical support posts and extending away and outwardly from at least one of the surfaces of the first and second opposed exterior surfaces on each of the first and second vertical support posts; and first and second support brackets, each of the first and second support brackets comprising a pair of spaced-apart opposed flanges and a surface orthogonal to and in contact with the pair of spaced-apart opposed flanges, wherein the first support bracket is configured such that in an assembled state of the shelving system the pair of spaced-apart opposed flanges of the first support bracket is coupled to the first vertical support post with one flange of the pair of spaced-apart opposed flanges positioned in contact with the first exterior surface of the first vertical support post and the other flange of the pair of spaced-apart opposed flanges is positioned in contact with the second exterior surface of the first vertical support post, wherein each flange of the pair of spaced-apart opposed flanges includes at least one aperture configured to releasably engage one of the plurality of support pins on the first vertical support post, each aperture formed as a slot with an open end, wherein the first support bracket is configured such that in the assembled state of the shelving system the surface that is orthogonal to and in contact with the pair of spaced-apart flanges contacts and extends across the third exterior surface of the first vertical support post, and wherein the first support bracket is configured such that in the assembled state of the shelving system the first support bracket cooperates with the first vertical support post to support the first side of the shelf on a support surface, and wherein the second support bracket is configured such that in the assembled state of the shelving system the second support bracket is coupled to and cooperates with the second vertical support post to support the second side of the shelf on a support surface; and first and second cooperating brackets, each of the first and second cooperating brackets comprising a coupling portion configured to removably couple the shelf with one of the first and second vertical support posts and a support portion connected to the coupling portion and configured to support one of the first and second sides of the shelf, wherein the coupling portion of the first cooperating bracket comprises a pair of spaced-apart fingers and a notch associated with each finger of the pair of spaced-apart fingers, wherein the pair of spaced-apart fingers and notches are configured such that in the assembled state of the shelving system the coupling portion constrains the first cooperating bracket from rotation relative to the first support bracket, wherein the first cooperating bracket is configured such that in the assembled state of the shelving system the first cooperating bracket is positioned between the first support bracket and the first side of the shelf to support the first side of the shelf, couples the shelf to the first support bracket, and spaces the first side of the shelf from the first support bracket, wherein the first cooperating bracket is configured such that in the assembled state of the shelving system the support portion supports a portion of the shelf and the coupling portion transmits a loading force from the first side of the shelf to the first vertical support post, wherein the first cooperating bracket is configured such that in the assembled state of the shelving system the first cooperating bracket does not extend above a top side of the first support bracket and hinders movement of the shelf in a direction orthogonal to a plane coincident with the third exterior surface of the first vertical support post, and wherein the second cooperating bracket is configured such that in the assembled state of the shelving system the second cooperating bracket is positioned between the second support bracket and the second side of the shelf to support the second side of the shelf, couples the shelf to the second vertical support post, and spaces the shelf from the second support bracket.

18. The shelving system of claim 17, wherein the shelf is a first shelf and the shelving system further comprises a second shelf and a third cooperating bracket configured such that in the assembled state of the shelving system the third cooperating bracket is positioned relative to the first support bracket to support the second shelf on the first vertical support post at a same height as the first shelf.

19. The shelving system of claim 17, wherein the first support bracket is configured such that in the assembled state of the shelving system the first support bracket couples the first vertical support post to the support surface and the second support bracket is configured such that in the assembled state of the shelving system the second support bracket couples the second vertical support post to the support surface.

20. The shelving system of claim 17, wherein the coupling portion and the support portion of each of the first and second cooperating brackets are formed from a single piece of material.

21. The shelving system of claim 17, wherein each of the first and second cooperating brackets is configured such that in the assembled state of the shelving system the shelf is fixed to the support portion of each of the first and second cooperating brackets.

22. The shelving system of claim 17, wherein each of the first and second cooperating brackets is configured such that in the assembled state of the shelving system a bottom side of the shelf is positioned above a bottom side of each of the first and second cooperating brackets.

23. The shelving system of claim 17, wherein each flange of the pair of spaced-apart opposed flanges of the first support bracket includes a plurality of apertures, each aperture formed as a slot with an open end and configured to releasably engage one of the plurality of support pins on the first vertical support post.

24. The shelving system of claim 17, wherein the flanges of the pair of spaced-apart opposed flanges of the first support bracket are separable.

25. The shelving system of claim 17, wherein the first cooperating bracket includes a flange having at least one aperture configured to releasably engage one of the plurality of support pins on the first vertical support post and the second cooperating bracket includes a flange having at least one aperture configured to releasably engage one of the plurality of support pins on the second vertical support post.

26. The shelving system of claim 17, wherein the third exterior surface of the first vertical support post defines a plane and the first cooperating bracket is configured such that upon movement of the pair of spaced-apart fingers parallel to a longitudinal axis of the first vertical support post to couple the first cooperating bracket to the first support bracket, the first cooperating bracket is constrained from movement orthogonal to the plane defined by the third exterior surface of the first vertical support post.

27. The shelving system of claim 17, wherein each of the first and second vertical support posts further comprises a first transition surface between the first exterior surface and the third exterior surface and a second transition surface between the second exterior surface and the third exterior surface.

28. The shelving system of claim 17, wherein each flange of the pair of spaced-apart opposed flanges of the first and second support brackets has an equal height and the surface of each of the first and second support brackets that is orthogonal to and in contact with the pair of spaced-apart opposed flanges has a height equal to the height of the flanges.

29. The shelving system of claim 17, wherein the first cooperating bracket is separable from the first support bracket.

30. The shelving system of claim 17, wherein in the assembled state of the shelving system the weight supporting surface of the shelf does not extend above a top side of each of the first and second support brackets.

* * * * *